US009441862B2

(12) United States Patent
Tamura et al.

(10) Patent No.: US 9,441,862 B2
(45) Date of Patent: Sep. 13, 2016

(54) AIR-CONDITIONING APPARATUS INCLUDING INTERMEDIATE HEAT EXCHANGERS

(75) Inventors: Asako Tamura, Chiyoda-ku (JP); Naofumi Takenaka, Chiyoda-ku (JP); Shinichi Wakamoto, Chiyoda-ku (JP); Susumu Yoshimura, Chiyoda-ku (JP); Koji Yamashita, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 270 days.

(21) Appl. No.: 14/006,551

(22) PCT Filed: Jan. 23, 2012

(86) PCT No.: PCT/JP2012/000397

§ 371 (c)(1),
(2), (4) Date: Sep. 20, 2013

(87) PCT Pub. No.: WO2012/132172

PCT Pub. Date: Oct. 4, 2012

(65) Prior Publication Data

US 2014/0007607 A1 Jan. 9, 2014

(30) Foreign Application Priority Data

Mar. 28, 2011 (JP) ..... 2011-070663

(51) Int. Cl.
*F25B 13/00* (2006.01)
*F25B 9/00* (2006.01)

(52) U.S. Cl.
CPC ..... *F25B 13/00* (2013.01); *F25B 9/008* (2013.01); *F25B 2309/06* (2013.01);

(Continued)

(58) Field of Classification Search
CPC ..... F25B 2313/0272; F25B 2309/06; F25B 2313/0233; F25B 9/008; F25B 2313/003; F25B 2313/006; F25B 13/00
See application file for complete search history.

(56) References Cited

U.S. PATENT DOCUMENTS 8,881,548 B2 * 11/2014 Wakamoto ..... F25B 13/00 62/513
2010/0050675 A1 3/2010 Kameyama et al.

FOREIGN PATENT DOCUMENTS

JP 2003 314920 11/2003
JP 2004-340418 A 12/2004

(Continued)

OTHER PUBLICATIONS

International Search Report Issued Apr. 24, 2012 in PCT/JP12/000397 Filed Jan. 23, 2012.

(Continued)

*Primary Examiner* — Marc Norman
*Assistant Examiner* — Ana Vazquez
(74) *Attorney, Agent, or Firm* — Oblon, McClelland, Maier & Neustadt, L.L.P.

(57) ABSTRACT

An air-conditioning apparatus in which a primary-side refrigerant in a two-phase gas-liquid state that has flowed into each of intermediate heat exchangers absorbs heat from a secondary-side refrigerant flowing in counterflow to the primary-side refrigerant, and evaporates and turns into a low-temperature, low-pressure gas state. The air-conditioning apparatus ensures high heat exchange efficiency even when a direction of a heat source-side refrigerant (secondary-side refrigerant) flowing through an intermediate heat exchanger changes, and enables an appropriate operation in any operation mode.

6 Claims, 19 Drawing Sheets

(52) U.S. Cl.
CPC ... *F25B 2313/003* (2013.01); *F25B 2313/006* (2013.01); *F25B 2313/0233* (2013.01); *F25B 2313/0272* (2013.01); *F25B 2400/121* (2013.01)

(56) References Cited

FOREIGN PATENT DOCUMENTS

| | | |
|---|---|---|
| WO | 2008 117408 | 10/2008 |
| WO | 2009 133640 | 11/2009 |
| WO | 2010 050006 | 5/2010 |
| WO | WO 2010/128557 A1 | 11/2010 |

OTHER PUBLICATIONS

Extended European Search Report issued Jan. 16, 2015 in Patent Application No. 12763704.9.
Combined Office Action and Search Report issued on Jul. 20, 2015 in Chinese Patent Application No. 201280015015.4 with partial English translation and English translation of category of cited documents.
Office Action issued Jul. 1, 2014 in Japanese Patent Application No. 2013-507080 with English language translation.

* cited by examiner

REFRIGERANT FLOW PATHS IN INTERMEDIATE HEAT EXCHANGER 7

REFRIGERANT FLOW PATHS IN INTERMEDIATE HEAT EXCHANGER 7

AIR-CONDITIONING APPARATUS INCLUDING INTERMEDIATE HEAT EXCHANGERS

TECHNICAL FIELD

The present invention relates to an air-conditioning apparatus that has two refrigerant circuits including a primary-side refrigerant circuit and a secondary-side refrigerant circuit, and causes heat to be exchanged between a primary-side refrigerant and a secondary-side refrigerant in an intermediate heat exchanger.

BACKGROUND ART

As an air-conditioning apparatus in related art, there has been proposed an air-conditioning apparatus capable of simultaneous cooling and the heating operation which "includes a heat source-side refrigerant circuit A having a compressor 11, an outdoor heat exchanger 13, a first refrigerant branch part 21 connected to the compressor 11, a second refrigerant branch part 22 and a third refrigerant branch part 23 connected to the outdoor heat exchanger 13, a first refrigerant flow control device 24 provided between a branch pipe 40 and the second refrigerant branch part 22, intermediate heat exchangers 25*n* whose one side is connected to the first refrigerant branch part 21 and the third refrigerant branch part 23 via three-way valves 26*n* and whose other side is connected to the second refrigerant branch part 22, and second refrigerant flow control devices 27*n* provided between each of the intermediate heat exchangers 25*n* and the second refrigerant branch part 22, and a use-side refrigerant circuit Bn having indoor heat exchangers 31*n* connected to the intermediate heat exchangers 25*n*, and in which at least one of water and brine circulates through the use-side refrigerant circuit Bn" (see Patent Literature 1).

CITATION LIST

Patent Literature

Patent Literature 1: WO2009/133640 (Abstract)

SUMMARY OF INVENTION

Technical Problem

However, the air-conditioning apparatus described in Patent Literature 1 has the following problem. That is, while the direction of the heat source-side refrigerant flowing through the intermediate heat exchangers changes depending on the operation mode, the flow of the use-side refrigerant is a certain direction. Therefore, appropriate heat exchange efficiency is not obtained in intermediate heat exchangers in which these refrigerants are in parallel flow, which makes it impossible to perform optimum operation in all operation modes.

The present invention has been made in view of the problem mentioned above, and accordingly it is an object of the present invention to provide an air-conditioning apparatus which ensures high heat exchange efficiency even when the direction of a heat source-side refrigerant (secondary-side refrigerant) flowing through an intermediate heat exchanger changes, and enables an appropriate operation in any operation mode.

Solution to Problem

An air-conditioning apparatus according to the present invention includes a primary-side refrigerant circuit in which a compressor, first flow switching means, a heat source-side heat exchanger, second flow switching means, a plurality of intermediate heat exchangers, and an expansion mechanism are connected by refrigerant pipes, and through which a primary-side refrigerant flows, and a secondary-side refrigerant circuit in which the intermediate heat exchangers, third flow switching means, a pump, fourth flow switching means, and a plurality of use-side heat exchangers are connected by refrigerant pipes, and through which a secondary-side refrigerant different from the primary-side refrigerant flows. Each of the intermediate heat exchangers exchanges heat between the primary-side refrigerant and the secondary-side refrigerant. The first flow switching means switches a refrigerant flow path so that the primary-side refrigerant discharged from the compressor flows to each of the intermediate heat exchangers or the heat source-side heat exchanger. The second flow switching means switches a flow direction of the primary-side refrigerant flowing into each of the intermediate heat exchangers. The third flow switching means switches a flow direction of the secondary-side refrigerant flowing into each of the intermediate heat exchangers. The fourth flow switching means switches a refrigerant flow path to direct one of flows of the secondary-side refrigerant that have flown through the plurality of the intermediate heat exchangers to flow through the corresponding each use-side heat exchanger, so that one of a cooling operation and a heating operation is performed in a selectable manner by each of the use-side heat exchangers. The second flow switching means and the third flow switching means each switch a refrigerant flow path so that the primary-side refrigerant and the secondary-side refrigerant are in counterflow in at least one of the intermediate heat exchangers.

Advantageous Effects of Invention

According to the present invention, the primary-side refrigerant and the secondary-side refrigerant are in counterflow in at least one intermediate heat exchanger. Therefore, thermal effect of the primary-side refrigerant and the secondary-side refrigerant is exerted efficiently, thereby making it possible to reduce the input to the pump.

DESCRIPTION OF EMBODIMENTS

Embodiment 1

(Configuration of Air-Conditioning Apparatus)

Figure 1:
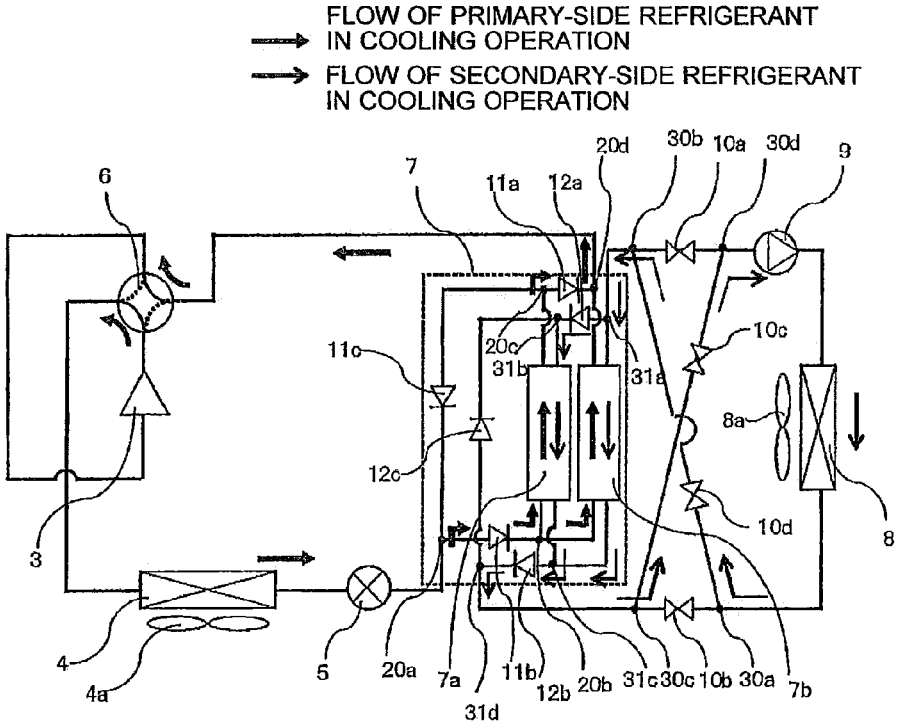
FIG. 1 is a schematic diagram of an air-conditioning apparatus according to Embodiment 1 of the present invention, illustrating the flow of a refrigerant in a cooling operation.
Figure 2:
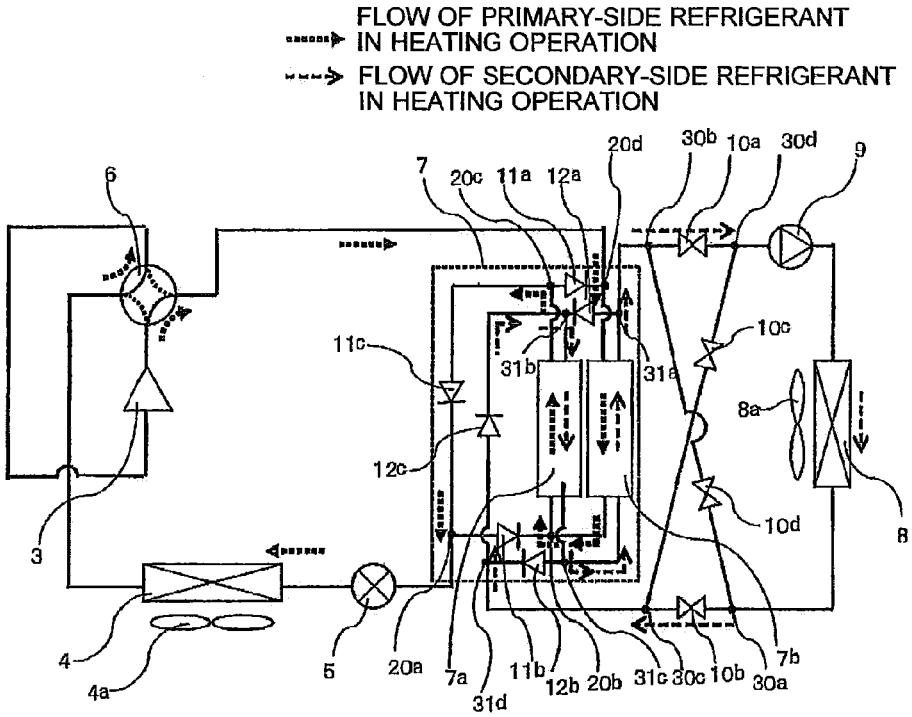
FIG. 2 is a schematic diagram of an air-conditioning apparatus according to Embodiment 1 of the present invention, illustrating the flow of refrigerant in the heating operation.

FIG. 1 is a schematic diagram of an air-conditioning apparatus according to Embodiment 1 of the present invention, illustrating the flow of a refrigerant in the cooling operation. FIG. 2 is a schematic diagram of the air-conditioning apparatus, illustrating the flow of refrigerant in the heating operation. Of the arrows in FIGS. 1 and 2, arrows indicated by thick lines indicate the flow of a primary-side refrigerant, and arrows indicated by narrow lines indicate the flow of a secondary-side refrigerant.

The air-conditioning apparatus according to Embodiment 1 includes two refrigerant circuits, a primary-side refrigerant circuit, and a secondary-side refrigerant circuit.

As the primary-side refrigerant that flows through the primary-side refrigerant circuit of these refrigerant circuits, for example, a fluorocarbon refrigerant such as R410A, a hydrocarbon refrigerant such as propane, a natural refrigerant such as carbon dioxide, or the like is used. It is also possible to use an azeotropic refrigerant mixture such as R410A, or a zeotropic refrigerant mixture such as R407C, R32, and R134a, or R32 and R1234yf.

As the secondary-side refrigerant that flows through the secondary-side refrigerant circuit, for example, brine, water, a liquid mixture of brine and water, a liquid mixture of water and an additive having an anti-corrosion effect, or the like is used.

The primary-side refrigerant circuit includes at least a compressor 3, an outdoor heat exchanger 4, an expansion mechanism 5, a four-way valve 6, and an intermediate heat exchanger 7. The primary-side refrigerant circuit is configured by connecting the compressor 3, the four-way valve 6, the outdoor heat exchanger 4, the expansion mechanism 5, the intermediate heat exchanger 7, the four-way valve 6, and the compressor 3 in this order by refrigerant pipes.

The secondary-side refrigerant circuit includes at least the intermediate heat exchanger 7, an indoor heat exchanger 8, a pump 9, and valves 10*a* to 10*d*. The secondary-side refrigerant circuit is configured by connecting the pump 9, the indoor heat exchanger 8, the valve 10*b*, the intermediate heat exchanger 7, the valve 10*a*, and the pump 9 in this order by refrigerant pipes. In the secondary-side refrigerant circuit, a branch part 30*a* on the refrigerant pipe connecting the indoor heat exchanger 8 and the valve 10*b* is connected to a branch part 30*b* on the refrigerant pipe connecting the valve 10*a* and the intermediate heat exchanger 7, by a refrigerant pipe via the valve 10*d*. Also, in the secondary-side refrigerant circuit, a branch part 30*c* on the refrigerant pipe connecting the intermediate heat exchanger 7 and the valve 10*b* is connected to a branch part 30*d* on the refrigerant pipe connecting the pump 9 and the valve 10*a*, by a refrigerant pipe via the valve 10*c*.

The intermediate heat exchanger 7 includes at least heat transfer units 7*a* and 7*b*, check valves 11*a* to 11*c*, and check valves 12*a* to 12*c*. As will be described later, each of the heat transfer units 7*a* and 7*b* exchanges heat between the primary-side refrigerant and the secondary-side refrigerant, and includes a refrigerant flow path through which the primary-side refrigerant flows and a refrigerant flow path through which the secondary-side refrigerant flows.

In the heat transfer unit 7*b*, one refrigerant outlet/inlet of the refrigerant flow path through which the primary-side refrigerant flows is connected to the four-way valve 6 by a refrigerant pipe. The other refrigerant outlet/inlet is connected to the expansion mechanism 5 by a refrigerant pipe via the check valve 11*b*.

In the heat transfer unit 7*a*, one refrigerant outlet/inlet of the refrigerant flow path through which the primary-side refrigerant flows is connected to a branch part 20*b* on the refrigerant pipe connecting the heat transfer unit 7*b* and the check valve 11*b*, by a refrigerant pipe. The other refrigerant outlet/inlet is connected to a branch part 20*d* on the refrigerant pipe connecting the heat transfer unit 7*b* and the four-way valve 6, by a refrigerant pipe via the check valve 11*a*.

Further, a branch part 20*c* on the refrigerant pipe connecting the heat transfer unit 7*a* and the check valve 11*a* is connected to a branch part 20*a* on the refrigerant pipe connecting the expansion mechanism 5 and the check valve 11*b*, by a refrigerant pipe via the check valve 11*c*.

In the heat transfer unit 7*b*, one refrigerant outlet/inlet of the refrigerant flow path through which the secondary-side refrigerant flows is connected to the valve 10*a* by a refrigerant pipe. The other refrigerant outlet/inlet is connected to the valve 10*b* by a refrigerant pipe via the check valve 12*b*.

In the heat transfer unit 7*a*, one refrigerant outlet/inlet of the refrigerant flow path through which the secondary-side refrigerant flows is connected to a branch part 31*c* on the refrigerant pipe connecting the heat transfer unit 7*b* and the check valve 12*b*, by a refrigerant pipe. The other refrigerant outlet/inlet is connected to a branch part 31*a* on the refrigerant pipe connecting the heat transfer unit 7*b* and the valve 10*a*, by a refrigerant pipe via the check valve 12*a*.

Further, a branch part 31*d* on the refrigerant pipe connecting the check valve 12*b* and the valve 10*b* is connected to a branch part 31*b* on the refrigerant pipe connecting the heat transfer unit 7*a* and the check valve 12*a*, by a refrigerant pipe via the check valve 12*c*.

The compressor 3 sucks the primary-side refrigerant in a gas state, compresses the primary-side refrigerant into a high-temperature, high-pressure state, and discharges the resulting primary-side refrigerant. The compressor 3 may be configured by, for example, an inverter compressor or the like whose capacity can be controlled.

The outdoor heat exchanger 4 functions as a radiator in the cooling operation, and functions as an evaporator in the heating operation. The outdoor heat exchanger 4 exchanges heat between the outdoor air supplied from a fan 4*a* and the primary-side refrigerant.

The expansion mechanism 5 expands and reduces the pressure of the primary-side refrigerant that has flowed out of the outdoor heat exchanger 4 in the cooling operation, and the primary-side refrigerant that has flowed out of the intermediate heat exchanger 7 in the heating operation.

The four-way valve 6 has the function of switching the refrigerant flow path. Specifically, in the cooling operation, the four-way valve 6 switches the refrigerant flow path so that the primary-side refrigerant discharged from the compressor 3 flows to the outdoor heat exchanger 4, and that the primary-side refrigerant that has flowed out of the intermediate heat exchanger 7 flows to the compressor 3. In the heating operation, the four-way valve 6 switches the refrigerant flow path so that the primary-side refrigerant discharged from the compressor 3 flows to the intermediate heat exchanger 7, and that the primary-side refrigerant that has flowed out of the outdoor heat exchanger 4 flows to the compressor 3.

The heat transfer units 7*a* and 7*b* are each configured by, for example, a double-pipe heat exchanger, a plate heat exchanger, a micro-channel water heat exchanger, or the like. As described above, each of the heat transfer units 7*a* and 7*b* includes a refrigerant flow path through which the primary-side refrigerant flows, and a refrigerant flow path through which the secondary-side refrigerant flows, and exchanges heat between the primary-side refrigerant and the secondary-side refrigerant. Specifically, each of the heat transfer units 7*a* and 7*b* causes the primary-side refrigerant to be heated by the secondary-side refrigerant in the cooling operation, and causes the primary-side refrigerant to be cooled by the secondary-side refrigerant in the heating operation.

In a case where a plate heat exchanger is used as each of the heat transfer units 7*a* and 7*b*, by taking phase change of the primary-side refrigerant into consideration, each of the heat transfer units 7*a* and 7*b* is preferably installed in such an orientation that the primary-side refrigerant flows into each of the heat transfer units 7*a* and 7*b* from the lower side when the primary-side refrigerant absorbs heat, and that the primary-side refrigerant flows into each of the heat transfer units 7*a* and 7*b* from the upper side when the primary-side refrigerant radiates heat.

The indoor heat exchanger 8 functions as a cooler in the cooling operation, and functions as a radiator in the heating operation. The indoor heat exchanger 8 exchanges heat between the indoor air supplied from a fan 8*a* and the secondary-side refrigerant.

The pump 9 causes the secondary-side refrigerant to circuit within the secondary-side refrigerant circuit as the pump 9 is driven.

The valves 10*a* to 10*d* are opening and closing valves, which conduct the secondary-side refrigerant when open, and shut off the flow of the secondary-side refrigerant when closed. Specifically, the valves 10*a* to 10*d* have the function of switching the outlet/inlet through which the secondary-side refrigerant that has flowed out of the indoor heat exchanger 8 flows into the intermediate heat exchanger 7.

The check valves 11*a* to 11*c* cause the primary-side refrigerant to flow in only one direction. Specifically, the check valve 11*a* causes the primary-side refrigerant to flow only in a direction from the branch part 20*c* toward the branch part 20*d*. The check valve 11*b* causes the primary-side refrigerant to flow only in a direction from the branch part 20*a* toward the branch part 20*b*. The check valve 11*c* causes the primary-side refrigerant to flow only in a direction from the branch part 20*c* toward the branch part 20*a*.

The check valves 12*a* to 12*c* cause the secondary-side refrigerant to flow in only one direction. Specifically, the check valve 12*a* causes the secondary-side refrigerant to flow only in a direction from the branch part 31*a* toward the branch part 31*b*. The check valve 12*b* causes the secondary-side refrigerant to flow only in a direction from the branch part 31*c* toward the branch part 31*d*. The check valve 12*c* causes the secondary-side refrigerant to flow only in a direction from the branch part 31*d* toward the branch part 31*b*.

While the branch parts 20*a* to 20*d*, 30*a* to 30*d*, and 31*a* to 31*d* are provided on refrigerant pipes as illustrated in FIGS. 1 and 2 for the sake of convenience in explaining the refrigerant circuit configuration, this should not be construed restrictively. That is, these branch parts may not necessarily be provided on refrigerant pipes in a clear manner. For example, while the check valve 11*b* and the check valve 11*c* are both connected to the expansion mechanism 5 via the branch part 20*a*, the check valve 11*b* and the check valve 11*c* may be connected to the expansion mechanism 5 directly without passing through a clear branch part 20*a*. This configuration does not alter the function of the refrigerant circuit at all. Furthermore, for example, while the branch part 30*b* and the branch part 31*a* are configured as separate branch parts for the convenience of explanation of the refrigerant circuit, the branch part 30*b* and the branch part 31*a* may be configured as an integral branch part, and this configuration does not alter the function of the refrigerant circuit at all, either. The same applies to the other branch parts. As long as the function of the refrigerant circuit (such as the flow directions of the respective refrigerants) illustrated in FIGS. 1 and 2 remains the same, as mentioned above, it is not necessary to provide clear branch parts, nor is it necessary for the branch parts to be separated as separate components.

The outdoor heat exchanger 4 and the indoor heat exchanger 8 correspond to the "heat source-side heat exchanger" and the "use-side heat exchanger", respectively, in the invention according to claim 9 of the present invention. The four-way valve 6 and the valves 10*a* to 10*d* correspond to the "first flow switching means" and the "second flow switching means", respectively, in the invention according to claim 9 of the present invention. The check valves 11*a* to 11*c* and the check valves 12*a* to 12*c* each correspond to the "third flow switching means" according to claim 9 of the present invention.

(Cooling Operation of Air-Conditioning Apparatus)

Next, the cooling operation of an air-conditioning apparatus according to Embodiment 1 will be described with reference to FIG. 1.

In the primary-side refrigerant circuit, the four-way valve 6 is switched in advance so that the primary-side refrigerant discharged from the compressor 3 flows to the outdoor heat exchanger 4, and that the primary-side refrigerant that has flowed out of the intermediate heat exchanger 7 flows to the compressor 3. In the secondary-side refrigerant circuit, the valve 10*a* and the valve 10*b* are closed, and the valve 10*c* and the valve 10*d* are open.

First, the flow of the primary-side refrigerant in the primary-side refrigerant circuit will be described. The primary-side refrigerant in a low-temperature, low-pressure gas state is compressed by the compressor 3, and discharged in a high-temperature, high-pressure state. The high-temperature, high-pressure primary-side refrigerant discharged from the compressor 3 flows into the outdoor heat exchanger 4 via the four-way valve 6. The primary-side refrigerant that has flowed into the outdoor heat exchanger 4 radiates heat to the outdoor air sent by the fan 4*a*, and a part or the entire primary-side refrigerant condenses and turns into a two-phase gas-liquid state or liquid state. The primary-side refrigerant in a two-phase gas-liquid state or liquid state that has flowed out of the outdoor heat exchanger 4 flows into the expansion mechanism 5, where the primary-side refrigerant is expanded and reduced in pressure and turns into a two-phase gas-liquid state at low temperature and low pressure. The primary-side refrigerant in a two-phase gas-liquid state at low temperature and low pressure that has flowed out of the expansion mechanism 5 flows into the intermediate heat exchanger 7.

After the primary-side refrigerant in a two-phase gas-liquid state that has flowed into the intermediate heat exchanger 7 passes through the branch part 20*a* and the check valve 11*b*, the primary-side refrigerant divides into branch flows at the branch part 20*b*, and the branch flows flow into the heat transfer unit 7*a* and the heat transfer unit 7*b* in parallel, respectively. At this time, at the branch part 20*a*, the primary-side refrigerant does not flow in a direction from the branch part 20*a* toward the branch part 20*c* owing to the action of the check valve 11*c*. The flows of the primary-side refrigerant in a two-phase gas-liquid state that have flowed into the heat transfer unit 7*a* and the heat transfer unit 7*b* absorb heat from the secondary-side refrigerant flowing in counterflow to the primary-side refrigerant, and evaporates and turns into a low-temperature, low-pressure gas state. The primary-side refrigerant in a gas state that has flowed out of the heat transfer unit 7*a* passes though the branch part 20*c* and the check valve 11*a*, merges at the branch part 20*d* with the primary-side refrigerant in a gas state that has flowed out of the heat transfer unit 7*b*, and the merged primary-side refrigerant flows out of the intermediate heat exchanger 7.

The primary-side refrigerant in a gas state that has flowed out of the intermediate heat exchanger 7 is sucked into the compressor 3 via the four-way valve 6, and is compressed again.

Next, the flow of the secondary-side refrigerant in the secondary-side refrigerant circuit will be described. The secondary-side refrigerant sent out by driving of the pump 9 flows into the indoor heat exchanger 8. The secondary-side refrigerant that has flowed into the indoor heat exchanger 8 cools the indoor air sent by the fan 8*a*, and flows into the intermediate heat exchanger 7 via the branch part 30*a*, the valve 10*d*, and the branch part 30*b*. At this time, at the branch part 30*a*, the secondary-side refrigerant does not flow in a direction from the branch part 30*a* toward the branch part 30*c* because the valve 10*b* is closed. Also, at the branch part 30*b*, the secondary-side refrigerant does not flow in a direction from the branch part 30*b* toward the branch part 30*d* because the valve 10*a* is closed.

The secondary-side refrigerant that has flowed into the intermediate heat exchanger 7 divides into branch flows at the branch part 31*a*, one of which flows into the heat transfer unit 7*b*, and the other flows into the heat transfer unit 7*a* via the check valve 12*a* and the branch unit 31*b*. At this time, at the branch part 31*b*, the secondary-side refrigerant does not flow in a direction from the branch part 31*b* toward the branch part 31*d* owing to the action of the check valve 12*c*. The flows of the secondary-side refrigerant that have flowed into the heat transfer unit 7*a* and the heat transfer unit 7*b* in parallel are cooled by the primary-side refrigerant in a low-temperature state flowing in counterflow to the secondary-side refrigerant, and flow into the heat transfer unit 7*a* and the heat transfer unit 7*b*, respectively. The respective flows of the secondary-side refrigerant that have flowed out of the heat transfer unit 7*a* and the heat transfer unit 7*b* merge at the branch part 31*c*, and the merged secondary-side refrigerant flows out of the intermediate heat exchanger 7 via the check valve 12*b* and the branch part 31*d*.

The secondary-side refrigerant that has flowed out of the intermediate heat exchanger 7 flows into the pump 9 via the branch part 30*c*, the valve 10*c*, and the branch part 30*d*, and is sent out again. At this time, at the branch part 30*c*, the secondary-side refrigerant does not flow in a direction from the branch part 30*c* toward the branch part 30*a* because the valve 10*b* is closed. Also, at the branch part 30*d*, the secondary-side refrigerant does not flow in a direction from the branch part 30*d* toward the branch part 30*b* because the valve 10*a* is closed.

(Heating Operation of Air-Conditioning Apparatus)

Next, the heating operation in the air-conditioning apparatus according to Embodiment 1 will be described with reference to FIG. 2.

In the primary-side refrigerant circuit, the four-way valve 6 is switched in advance so that the primary-side refrigerant discharged from the compressor 3 flows to the intermediate heat exchanger 7, and that the primary-side refrigerant that has flowed out of the outdoor heat exchanger 4 flows to the compressor 3. In the secondary-side refrigerant circuit, the valve 10*a* and the valve 10*b* are open, and the valve 10*c* and the valve 10*d* are closed.

First, the flow of the primary-side refrigerant in the primary-side refrigerant circuit will be described. The primary-side refrigerant in a low-temperature, low-pressure gas state is compressed by the compressor 3, and discharged in a high-temperature, high-pressure state. The high-temperature, high-pressure primary-side refrigerant discharged from the compressor 3 flows into the intermediate heat exchanger 7 via the four-way valve 6.

The primary-side refrigerant that has flowed into the intermediate heat exchanger 7 flows into the heat transfer unit 7*b* via the branch part 20*d*, and radiates heat to the secondary-side refrigerant flowing in counterflow to the primary-side refrigerant. At this time, at the branch part 20*d*, the primary-side refrigerant does not flow in a direction from the branch part 20*d* toward the branch part 20*c* owing to the action of the check valve 11*a*. The primary-side refrigerant that has flowed out of the heat transfer unit 7*b* flows into the heat transfer unit 7*a* via the branch part 20*b*. In the heat transfer unit 7*a* as well, the primary-side refrigerant radiates heat to the secondary-side refrigerant flowing in counterflow to the primary-side refrigerant. At this time, at the branch part 20*b*, the primary-side refrigerant does not flow in a direction from the branch part 20*b* toward the branch part 20*a* owing to the action of the check valve 11*b*. In this way, unlike the cooling operation described above, the primary-side refrigerant flows through the heat transfer unit 7*b* and the heat transfer unit 7*a* in series. During this process, the primary-side refrigerant radiates heat to the secondary-side refrigerant, and a part or the entire primary-side refrigerant condenses and turns into a two-phase gas-liquid state or liquid state. The primary-side refrigerant in a two-phase gas-liquid state or liquid state that has flowed out of the heat transfer unit 7*a* flows out of the intermediate heat exchanger 7 via the branch part 20*c*, the check valve 11*c*, and the branch part 20*a*.

The primary-side refrigerant in a two-phase gas-liquid state or liquid state that has flowed out of the intermediate heat exchanger 7 flows into the expansion mechanism 5, where the primary-side refrigerant is expanded and reduced in pressure and turns into a two-phase gas-liquid state at low temperature and low pressure. The primary-side refrigerant in a two-phase gas-liquid state at low temperature and low pressure that has flowed out of the expansion mechanism 5 flows into the outdoor heat exchanger 4. The primary-side refrigerant that has flowed into the outdoor heat exchanger 4 absorbs heat from the outdoor air sent by the fan 4*a*, and evaporates and turns into a low-temperature, low-pressure gas state. The primary-side refrigerant in a gas state that has flowed out of the outdoor heat exchanger 4 is sucked into the compressor 3 via the four-way valve 6, and is compressed again.

Next, the flow of the secondary-side refrigerant in the secondary-side refrigerant circuit will be described. The secondary-side refrigerant sent out by driving of the pump 9 flows into the indoor heat exchanger 8. The secondary-side refrigerant that has flowed into the indoor heat exchanger 8 heats the indoor air sent by the fan 8*a*, and flows into the intermediate heat exchanger 7 via the branch part 30*a*, the valve 10*b*, and the branch part 30*c*. At this time, at the branch part 30*a*, the secondary-side refrigerant does not flow in a direction from the branch part 30*a* toward the branch part 30*b* because the valve 10*d* is closed. Also, at the branch part 30*c*, the secondary-side refrigerant does not flow in a direction from the branch part 30*c* toward the branch part 30*d* because the valve 10*c* is closed.

The secondary-side refrigerant that has flowed into the intermediate heat exchanger 7 flows into the heat transfer unit 7*a* via the branch part 31*d*, the check valve 12*c*, and the branch part 31*b*, and is heated by the primary-side refrigerant flowing in counterflow to the secondary-side refrigerant. At this time, at the branch part 31*d*, the secondary-side refrigerant does not flow in a direction from the branch part 31*d* toward the branch part 31*c* owing to the action of the check valve 12*b*. Also, at the branch part 31*b*, the secondary-side refrigerant does not flow in a direction from the branch part 31*b* toward the branch part 31*a* owing to the action of the check valve 12*a*. The secondary-side refrigerant that has flowed out of the heat transfer unit 7*a* flows into the heat transfer unit 7*b* via the branch part 31*c*, and is heated by the primary-side refrigerant flowing in counterflow to the secondary-side refrigerant. In this way, unlike the cooling operation described above, the secondary-side refrigerant flows through the heat transfer unit 7*a* and the heat transfer unit 7*b* in series. The secondary-side refrigerant that has flowed out of the heat transfer unit 7*b* flows out of the intermediate heat exchanger 7 via the branch part 31*a*.

The secondary-side refrigerant that has flowed out of the intermediate heat exchanger 7 flows into the pump 9 via the branch part 30*b*, the valve 10*a*, and the branch part 30*d*, and is sent out again. At this time, at the branch part 30*b*, the secondary-side refrigerant does not flow in a direction from the branch part 30*b* toward the branch part 30*a* because the valve 10*d* is closed. Also, at the branch part 30*d*, the secondary-side refrigerant does not flow in a direction from the branch part 30*d* toward the branch part 30*c* because the valve 10*c* is closed.

(Heat Exchange Operation in Intermediate Heat Exchanger 7)

Figure 3:
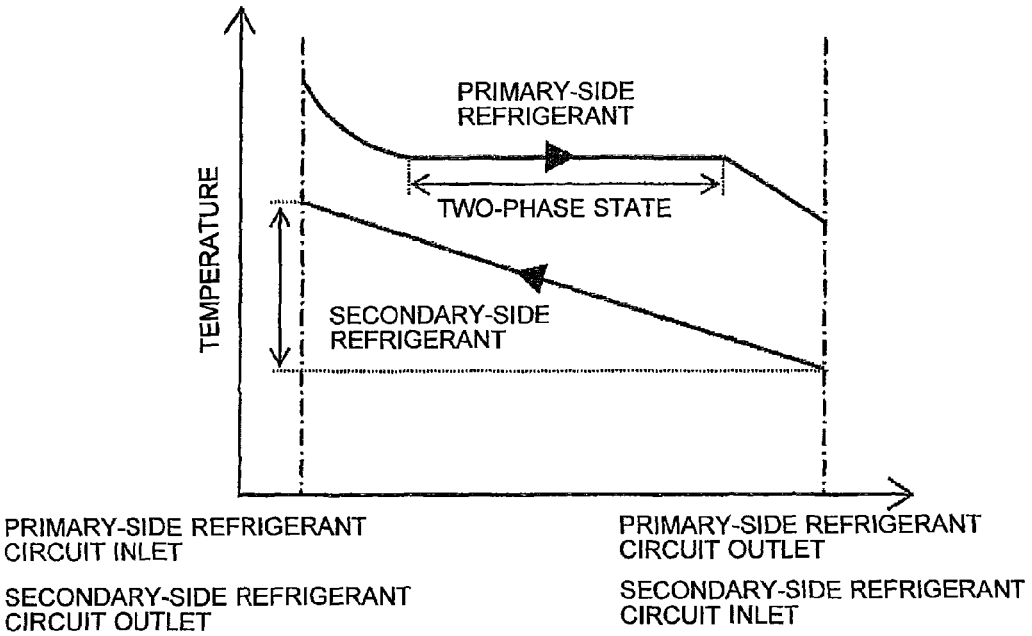
FIG. 3 illustrates the temperature relationship between a primary-side refrigerant and a secondary-side refrigerant in an intermediate heat exchanger 7 in the heating operation, in a case where a refrigerant whose discharge pressure is lower than the critical point is used as the primary-side refrigerant in the air-conditioning apparatus according to Embodiment 1 of the present invention.
Figure 4:
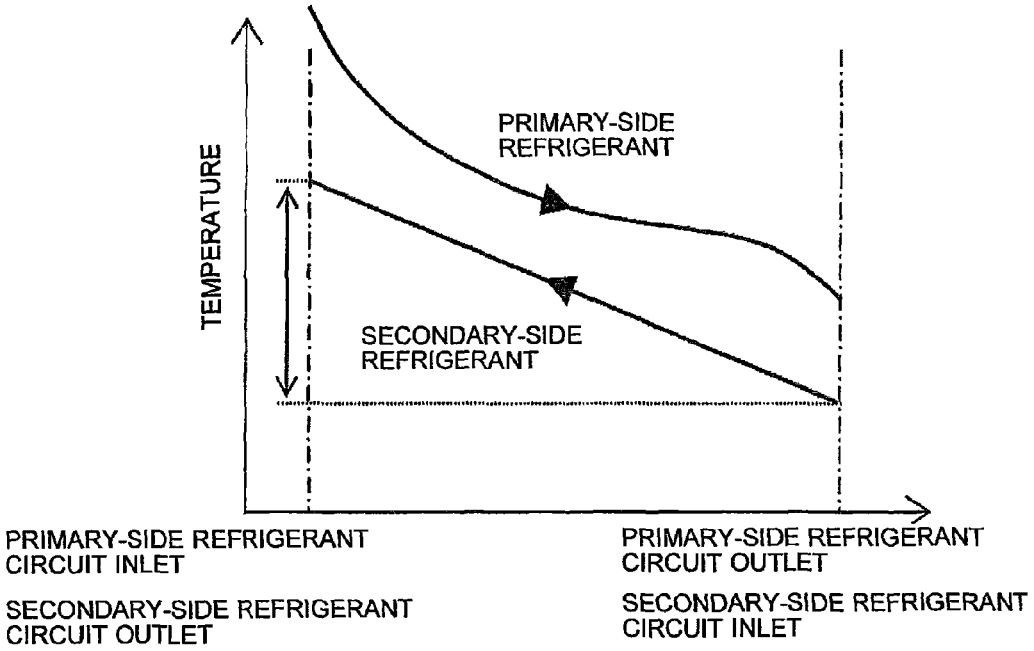
FIG. 4 illustrates the temperature relationship between the primary-side refrigerant and the secondary-side refrigerant in the intermediate heat exchanger 7 in the heating operation, in a case where a refrigerant whose discharge pressure is higher than the critical point is used as the primary-side refrigerant in the air-conditioning apparatus according to Embodiment 1 of the present invention.

FIG. 3 illustrates the temperature relationship between the primary-side refrigerant and the secondary-side refrigerant in the intermediate heat exchanger 7 in the heating operation, in a case where a refrigerant whose discharge pressure is lower than the critical point is used as the primary-side refrigerant in the air-conditioning apparatus according to Embodiment 1 of the present invention. FIG. 4 illustrates the temperature relationship between the primary-side refrigerant and the secondary-side refrigerant in the intermediate heat exchanger 7 in the heating operation, in a case where a refrigerant whose discharge pressure is higher than the critical point is used as the primary-side refrigerant in the air-conditioning apparatus.

Unlike the primary-side refrigerant at a low discharge pressure as illustrated in FIG. 3, the primary-side refrigerant at a high discharge pressure as illustrated in FIG. 4 has high discharge temperature, and does not become a two-phase state in the intermediate heat exchanger 7, resulting in large amount of heat exchange with the secondary-side refrigerant. Therefore, a large target value can be set for the outlet-inlet temperature difference in the intermediate heat exchanger 7 through which the secondary-side refrigerant flows, or for the outlet-inlet temperature difference in the indoor heat exchanger 8, thereby making it possible to reduce the input to the pump 9.

Advantageous Effects of Embodiment 1

According to the configuration and the operation mentioned above, in the intermediate heat exchanger 7, in the cooling operation in which the primary-side refrigerant absorbs heat from the secondary-side refrigerant, the primary-side refrigerant flows through the heat transfer unit 7*a* and the heat transfer unit 7*b* in parallel, and in the heating operation in which the primary-side refrigerant radiates heat to the secondary-side refrigerant, the primary-side refrigerant flows through the heat transfer unit 7*a* and the heat transfer unit 7*b* in series. In this regard, generally, with regard to operation efficiency, pressure loss exerts a greater influence than heat transfer capacity in the heat absorption process, whereas heat transfer capacity exerts a greater influence than pressure loss in the heat radiation process. Accordingly, in the air-conditioning apparatus according to Embodiment 1, in the cooling operation, the primary-side refrigerant performs a heat absorption operation in the intermediate heat exchanger 7, and flows through the heat transfer unit 7*a* and the heat transfer unit 7*b* in parallel so that the overall cross-sectional area of the flow path becomes large. Therefore, pressure loss that tends to exert a great influence in the heat absorption process can be reduced, thereby making it possible to reduce the input to the compressor 3. In the heating operation, the primary-side refrigerant performs a heat radiation operation in the intermediate heat exchanger 7, and flows through the heat transfer unit 7*a* and the heat transfer unit 7*b* in series so that the overall cross-sectional area of the flow path becomes small. Thus, flow velocity increases, thereby making it possible to promote heat transfer. Therefore, highly efficient operation is possible in both the cooling operation and the heating operation.

As illustrated in FIGS. 1 and 2, the heat transfer unit 7*a* exists in which the flow directions of both the primary-side refrigerant and the secondary-side refrigerant do not change even when the overall cross-sectional area of the flow path in the intermediate heat exchanger 7 changes as cooling and the heating operations are switched. Consequently, it is possible to take measures such as optimization of refrigerant distribution.

In the cooling operation and the heating operation, even when the flow direction of the secondary-side refrigerant is switched, the secondary-side refrigerant flows through the indoor heat exchanger 8 only in one direction, and in either case, heat exchange with the indoor air is performed in the same manner, resulting in high heat exchange efficiency.

In a case where a refrigerant whose discharge pressure is higher than the critical point is used as the primary-side refrigerant, in the heating operation, an effect due to lowering of the outlet temperature of the primary-side refrigerant in the intermediate heat exchanger 7 can be expected. In this case, the outlet-inlet temperature difference of the secondary-side refrigerant can be made large, and the flow rate of the secondary-side refrigerant can be reduced, thereby making it possible to reduce the input to the pump 9.

In the air-conditioning apparatus illustrated in FIGS. 1 and 2, use of the check valves 11*a* to 11*c* and 12*a* to 12*c* makes it unnecessary to perform operations other than operations of the four-way valve 6 and valves 10*a* to 10*d*, for switching of the overall cross-sectional area of the flow path in the intermediate heat exchanger 7 due to switching of cooling and the heating operations. Consequently, in the vicinity of the intermediate heat exchanger 7, problems such as leakage of refrigerant from valves can be prevented, thereby enabling safe operation.

Figure 5:
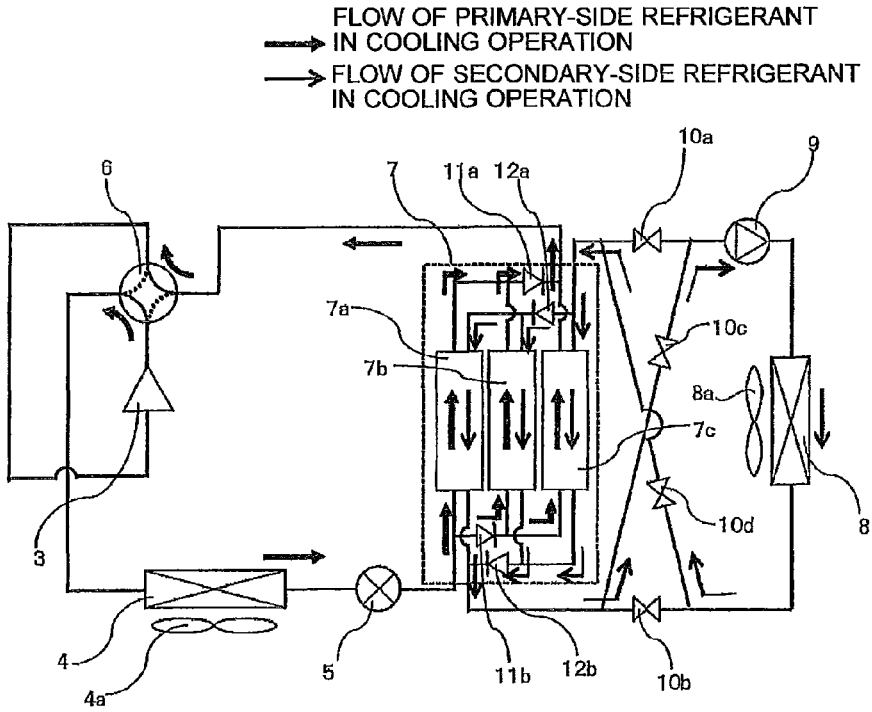
FIG. 5 illustrates the flow of refrigerant in the cooling operation in a case where the intermediate heat exchanger 7 includes three heat transfer units.
Figure 6:
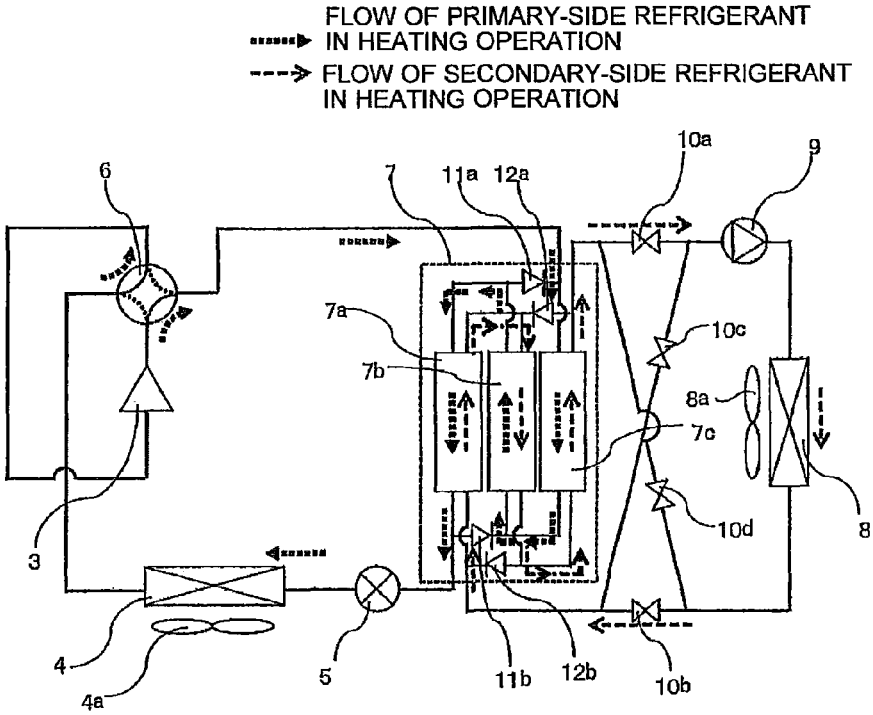
FIG. 6 illustrates the flow of refrigerant in the heating operation in a case where the intermediate heat exchanger 7 includes three heat transfer units.

While the air-conditioning apparatus illustrated in FIGS. 1 and 2 is configured so that the intermediate heat exchanger 7 includes two heat transfer units such as the heat transfer unit 7*a* and the heat transfer unit 7*b*, this should not be construed restrictively. The intermediate heat exchanger 7 may include three or more heat transfer units. As an example in this case, FIG. 5 illustrates the flow of refrigerant in the cooling operation in a case where the intermediate heat exchanger 7 includes three heat transfer units (heat transfer units 7*a* to 7*c*), and FIG. 6 illustrates the flow of refrigerant in the heating operation in the case of the same configuration. In a case where the number of heat transfer units is an even number, the resulting configuration is the same as the configuration illustrated in FIGS. 1 and 2. That is, letting 2n (n is a natural number not smaller than 1) represent the number of heat transfer units, the number of check valves belonging to the primary-side refrigerant circuit within the intermediate heat exchanger 7 (the check valves 11*a* to 11*c* in FIGS. 1 and 2), and the number of check valves belonging to the secondary-side refrigerant circuit (the check valves 12*a* to 12*c* in FIGS. 1 and 2) are each expressed as (2n+1). In a case where the number of heat transfer units is an odd number, the resulting configuration is the same as the configuration illustrated in FIGS. 5 and 6. That is, letting (2n+1) represent the number of heat transfer units, the number of check valves belonging to the primary-side refrigerant circuit within the intermediate heat exchanger 7 (the check valves 11*a* and 11*b* in FIGS. 5 and 6), and the number of check valves belonging to the secondary-side refrigerant circuit (the check valves 12*a* and 12*b* in FIGS. 5 and 6) are each expressed as 2n. Therefore, the number of check valves to be installed relative to the number of heat transfer units can be reduced in the case where the number of heat transfer units is an odd number.

In a case where the number of heat transfer units in the intermediate heat exchanger 7 is an even number, the number of the above-mentioned heat transfer units in which the flow directions of both the primary-side refrigerant and the secondary-side refrigerant do not change equals 50% of the total number of heat transfer units. In a case where the number of heat transfer units in the intermediate heat exchanger 7 is an odd number, provided that the number is three, the number of heat transfer units in which both of the flow directions do not change equals 33.3% of the total number of heat transfer units and its ratio becomes the lowest. That is, in the case where the number of heat transfer units is an odd number, when the number of heat transfer units is larger than three, and as the number of heat transfer units becomes larger, the ratio of the number of heat transfer units in which both of the flow directions do not change to the total number of heat transfer units becomes larger.

The check valves 11*a* to 11*c* and 12*a* to 12*c* within the intermediate heat exchanger 7 in the air-conditioning apparatus illustrated in FIGS. 1, 2, 5, and 6 may be valves that can be opened and closed. In this case, for example, in a case where there are two heat transfer units as illustrated in FIGS. 1 and 2, in the cooling operation, the valves corresponding to the check valves 11*a*, 11*b*, 12*a*, and 12*b* may be opened, and the valves corresponding to the check valves 11*c* and 12*c* may be closed. In the heating operation, the open/close states of these valves may be reversed. In a case here the number of heat transfer units is an odd number, all valves may be opened in the cooling operation, and all valves may be closed in the heating operation.

The pump 9 may be a pump whose flow rate can be controlled. In this case, the target value of the outlet-inlet temperature difference of the secondary-side refrigerant in the intermediate heat exchanger 7, or the outlet-inlet temperature difference of the secondary-side refrigerant in the indoor heat exchanger 8 can be made larger in the heating operation than in the cooling operation, thereby enabling an appropriate operation in both the cooling operation and the heating operation.

As for the four valves 10*a* to 10*d* used to switch the direction of the secondary-side refrigerant flowing into the intermediate heat exchanger 7, as another means, two three-way valves or one four-way valve may be used to form a circuit for switching the flow path direction. In this case, it is possible to reduce the number of components.

While one indoor unit having the indoor heat exchanger 8 is illustrated as an indoor unit as in FIG. 1 or the like, this should not be construed restrictively. The number of indoor units may be two or more.

Embodiment 2

(Configuration of Air-Conditioning Apparatus)

Figure 7:
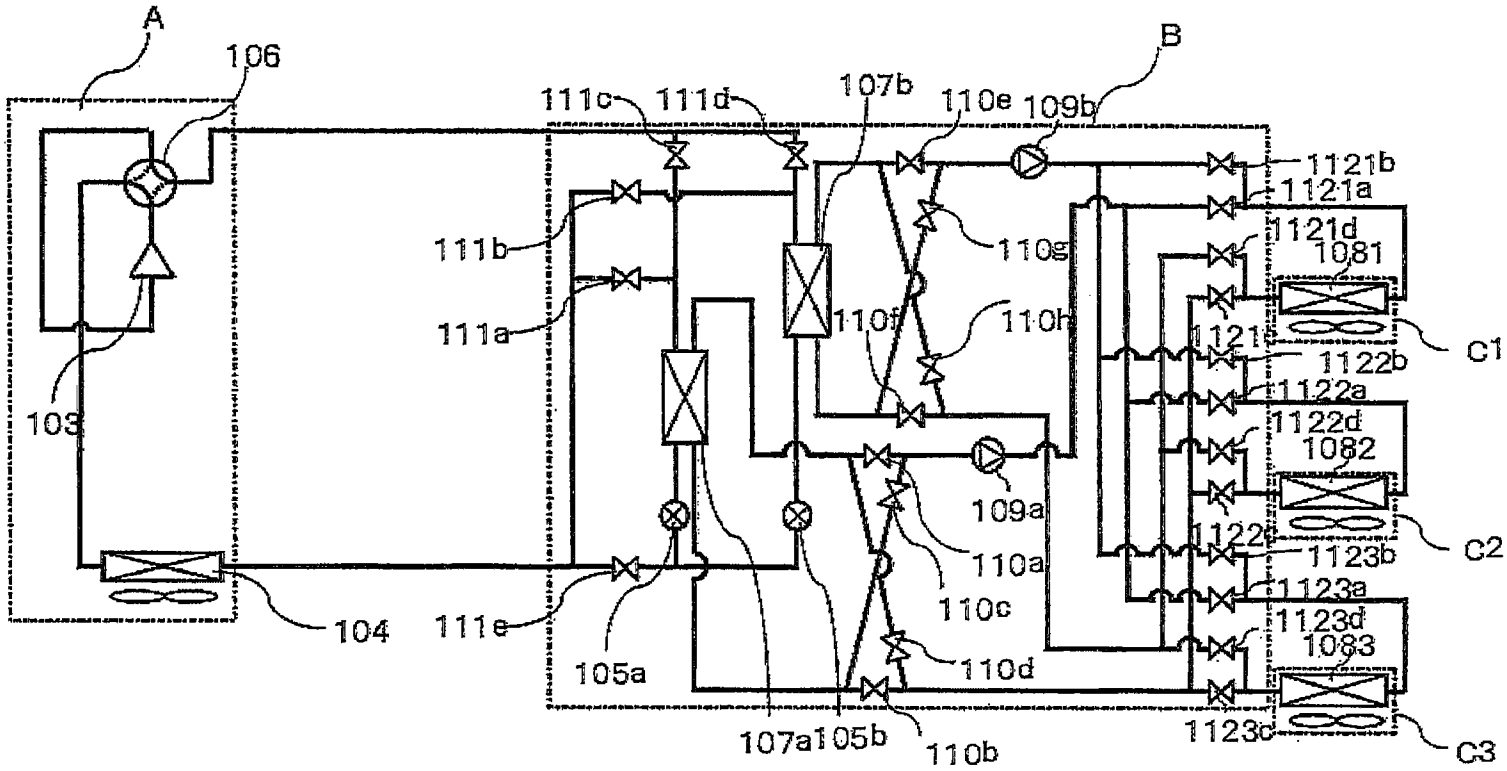
FIG. 7 is a schematic diagram of an air-conditioning apparatus according to Embodiment 2 of the present invention.

FIG. 7 is a schematic diagram of an air-conditioning apparatus according to Embodiment 2 of the present invention.

The air-conditioning apparatus according to Embodiment 2 allows each individual indoor unit to freely select a cooling operation or the heating operation as an operation mode, by use of a primary-side refrigerant circuit through which the primary-side refrigerant flows and a secondary-side refrigerant circuit through which the secondary-side refrigerant flows.

As illustrated in FIG. 7, as in Embodiment 1, the air-conditioning apparatus according to Embodiment 2 includes two refrigerant circuits, a primary-side refrigerant circuit, and a secondary-side refrigerant circuit. As the primary-side refrigerant that flows through the primary-side refrigerant circuit of these refrigerant circuits, for example, a fluorocarbon refrigerant such as R410A, a hydrocarbon refrigerant such as propane, a natural refrigerant such as carbon dioxide, or the like is used. It is also possible to use an azeotropic refrigerant mixture such as R410A, or a zeotropic refrigerant mixture such as R407C, R32, and R134a, or R32 and R1234yf. As the secondary-side refrigerant that flows through the secondary-side refrigerant circuit, for example, brine, water, a liquid mixture of brine and water, a liquid mixture of water and an additive having an anti-corrosion effect, or the like is used. Use of these kinds of secondary-side refrigerant contributes to improvement of safety because even if the secondary-side refrigerant leaks to the indoor space via an indoor unit C described later, a highly safe refrigerant is used as the secondary-side refrigerant.

The primary-side refrigerant circuit includes at least a compressor 103, an outdoor heat exchanger 104, expansion mechanisms 105*a* and 105*b*, a four-way valve 106, intermediate heat exchangers 107*a* and 107*b*, and valves 111*a* to 111*e*. Roughly speaking, the primary-side refrigerant circuit is configured by connecting the compressor 103, the four-way valve 106, the outdoor heat exchanger 104, the expansion mechanisms 105*a* and 105*b*, the intermediate heat exchangers 107*a* and 107*b*, the four-way valve 106, and the compressor 103 in this order by refrigerant pipes.

The secondary-side refrigerant circuit includes at least the intermediate heat exchangers 107*a* and 107*b*, indoor heat exchangers 108*n* (n is a natural number not smaller than 2, and represents the number of indoor heat exchangers. The same applies hereinafter. FIG. 7 illustrates a case where n=3.), pumps 109*a* and 109*b*, and valves 110*a* to 110*h* and 112*na* to 112*nd* (n in this case is the same as mentioned above). Roughly speaking, the secondary-side refrigerant circuit is configured by connecting the pumps 109*a* and 109*b*, the indoor heat exchangers 108*n*, the intermediate heat exchangers 107*a* and 107*b*, and the pumps 109*a* and 109*b* in this order by refrigerant pipes.

While the number of indoor heat exchangers is three (n=3) in Embodiment 2, the number may be two, or may be four or more.

That is, in the air-conditioning apparatus according to Embodiment 2, the primary-side refrigerant that circulates through the primary-side refrigerant circuit, and the secondary-side refrigerant that circulates through the secondary-side refrigerant circuit exchange heat in the intermediate heat exchangers 107*a* and 107*b*.

While the circuit configuration of each of the primary-side refrigerant circuit and the secondary-side refrigerant circuit mentioned above is a configuration based on a refrigerant circuit through which the same kind of refrigerant flows, as illustrated in FIG. 7, when considered on a unit basis, the air-conditioning apparatus according to Embodiment 2 includes an outdoor unit A that is a heat source unit, a plurality of indoor units C1 to C3 (hereinafter, simply referred to as indoor units C when no distinction is made between individual indoor units), and a relay unit B that is interposed between the outdoor unit A and the indoor units C1 to C3. The cooling energy or heating energy generated in the outdoor unit A is transmitted to the indoor units C via the relay unit B.

(Configuration of Outdoor Unit A)

The outdoor unit A is usually installed in an outdoor space such as the rooftop of a building. The outdoor unit A supplies cooling energy or heating energy to the indoor units C via the relay unit B. The outdoor unit A includes the compressor 103, the outdoor heat exchanger 104, and the four-way valve 106.

The compressor 103 sucks the primary-side refrigerant in a gas state, compresses the primary-side refrigerant into a high-temperature, high-pressure state, and discharges the resulting primary-side refrigerant. The compressor 103 may be configured by, for example, an inverter compressor or the like whose capacity can be controlled.

The outdoor heat exchanger 104 functions as a radiator in the cooling operation, and functions as an evaporator in the heating operation. The outdoor heat exchanger 104 exchanges heat between the outdoor air supplied from a fan and the primary-side refrigerant.

The four-way valve 106 switches between the flow of the primary-side refrigerant in the cooling operation (the cooling only operation mode and the cooling main operation mode described later), and the flow of the primary-side refrigerant in the heating operation (the heating only operation mode and the heating main operation mode described later). Specifically, in the cooling operation, the four-way valve 106 switches the refrigerant flow path so that the primary-side refrigerant discharged from the compressor 103 flows to the outdoor heat exchanger 104, and that the primary-side refrigerant that has flowed out of the relay unit B flows to the compressor 103. In the heating operation, the four-way valve 106 switches the refrigerant flow path so that the primary-side refrigerant discharged from the compressor 103 flows to the relay unit B, and that the primary-side refrigerant that has flowed out of the outdoor heat exchanger 104 flows to the compressor 103.

(Configuration of Relay Unit B)

The relay unit B is installed at, for example, a position different from the outdoor space and the indoor space, as a separate casing from the outdoor unit A and the indoor units C. The relay unit B serves as a relay connecting the outdoor unit A and the indoor units C by refrigerant pipes. The relay unit B includes the intermediate heat exchangers 107*a* and 107*b*, the expansion mechanisms 105*a* and 105*b*, the pumps 109*a* and 109*b*, and the valves 110*a* to 110*h*, 111*a* to 111*e*, and 112*na* to 112*nd*.

The intermediate heat exchangers 107*a* and 107*b* are each configured by, for example, a double-pipe heat exchanger, a plate heat exchanger, a micro-channel water heat exchanger, a shell-and-tube heat exchanger, or the like. Each of the intermediate heat exchangers 107*a* and 107*b* includes a refrigerant flow path through which the primary-side refrigerant flows, and a refrigerant flow path through which the secondary-side refrigerant flows. Each of the intermediate heat exchangers 107*a* and 107*b* functions as a radiator or an evaporator to exchange heat between the primary-side refrigerant and the secondary-side refrigerant. Of these, the intermediate heat exchanger 107*a* is provided between the expansion mechanism 105*a* and the valve 111*c* in the primary-side refrigerant circuit, and is provided between the valve 110*a* and the valve 110*b* in the secondary-side refrigerant circuit. The intermediate heat exchanger 107*b* is provided between the expansion mechanism 105*b* and the valve 111*d* in the primary-side refrigerant circuit, and is provided between the valve 110*e* and the valve 110*f* in the secondary-side refrigerant circuit.

In a case where a plate heat exchanger is used as each of the intermediate heat exchangers 107*a* and 107*b*, by taking phase change of the primary-side refrigerant into consideration, each of the intermediate heat exchangers 107*a* and 107*b* is preferably installed in such an orientation that the primary-side refrigerant flows into each of the intermediate heat exchangers 107*a* and 107*b* from the lower side when the primary-side refrigerant absorbs heat, and that the primary-side refrigerant flows into each of the intermediate heat exchangers 107*a* and 107*b* from the upper side when the primary-side refrigerant radiates heat.

The expansion mechanisms 105*a* and 105*b* have the function of a pressure reducing/expansion valve in the primary-side refrigerant circuit, and cause the primary-side refrigerant to be reduced in pressure and expand. Of these, in the primary-side refrigerant circuit, the expansion mechanism 105*a* is provided between the intermediate heat exchanger 107*a* and the valve 111*e*, and the expansion mechanism 105*b* is provided between the intermediate heat exchanger 107*b* and the valve 111*e*. The expansion mechanisms 105*a* and 105*b* may each be configured by a mechanism whose opening degree (opening area) can be variably controlled, for example, an electronic expansion valve or the like.

The valves 111*a* to 111*e* are each configured by a two-way valve or the like. The valves 111*a* to 111*e* each open and close a refrigerant pipe in the primary-side refrigerant circuit, and switch the flow path of the primary-side refrigerant flowing into and flowing out of the relay unit B in the primary-side refrigerant circuit. The valve 111*a* is provided in the refrigerant pipe that connects between the refrigerant pipe connecting the intermediate heat exchanger 107*a* and the valve 111*c*, and the refrigerant pipe connecting the valve 111*b* and the outdoor heat exchanger 104 (or the valve 111*e*). The valve 111*b* is provided in the refrigerant pipe that connects between the refrigerant pipe connecting the intermediate heat exchanger 107*b* and the valve 111*d*, and the refrigerant pipe connecting the valve 111*a* and the outdoor heat exchanger 104 (or the valve 111*e*). The valve 111*c* is provided in the refrigerant pipe connecting the four-way valve 106 and the intermediate heat exchanger 107*a*. The valve 111*d* is provided in the refrigerant pipe connecting the four-way valve 106 and the intermediate heat exchanger 107*b*. The valve 111*e* is provided in the refrigerant pipe connecting the outdoor heat exchanger 104 and the expansion mechanism 105*a* (or the expansion mechanism 105*b*).

Each of the pumps 109*a* and 109*b* pumps and circulates the secondary-side refrigerant within the secondary-side refrigerant circuit. The pumps 109*a* and 109*b* may each be configured by, for example, a pump or the like whose capacity can be controlled. The refrigerant pipe connected to the discharge side of the pump 109*a* divides into branches, which are respectively connected to the valves 1121*a*, 1122*a*, and 1123*a*. The refrigerant pipe connected to the suction side of the pump 109*a* is connected to the valve 110*a*. The refrigerant pipe connected to the discharge side of the pump 109*b* divides into branches, which are respectively connected to the valves 1121*b*, 1122*b*, and 1123*b*. The refrigerant pipe connected to the suction side of the pump 109*b* is connected to the valve 110*e*.

The valves 110*a* to 110*h* are each configured by a two-way valve or the like. In the secondary-side refrigerant circuit, the valves 110*a* to 110*h* each open and close a refrigerant pipe, and switch the flow path of the secondary-side refrigerant sent to each of the pumps 109*a* and 109*b*. The valve 110*a* is provided in the refrigerant pipe connecting the pump 109*a* and the intermediate heat exchanger 107*a*. The refrigerant pipe connected to one side of the valve 110*b* is connected to the intermediate heat exchanger 107*a*, and the refrigerant pipe connected to the other side divides into branches, which are respectively connected to the valves 1121*c*, 1122*c*, and 1123*c*. The valve 110*c* is provided in the refrigerant pipe that connects between the refrigerant pipe connecting the pump 109*a* and the valve 110*a*, and the refrigerant pipe connecting the intermediate heat exchanger 107*a* and the valve 110*b*. The valve 110*d* is provided in the refrigerant pipe that connects between the refrigerant pipe connecting the intermediate heat exchanger 107*a* and the valve 110*a*, and the refrigerant pipe connecting the valve 110*b* and each of the valves 1121*c*, 1122*c*, and 1123*c*. The valve 110*e* is provided in the refrigerant pipe connecting the pump 109*b* and the intermediate heat exchanger 107*b*. The refrigerant pipe connected to one side of the valve 110*f* is connected to the intermediate heat exchanger 107*b*, and the refrigerant pipe connected to the other side divides into branches, which are respectively connected to the valves 1121*d*, 1122*d*, and 1123*d*. The valve 110*g* is provided in the refrigerant pipe that connects between the refrigerant pipe connecting the pump 109*b* and the valve 110*e*, and the refrigerant pipe connecting the intermediate heat exchanger 107*b* and the valve 110*f*. The valve 110*h* is provided in the refrigerant pipe that connects between the refrigerant pipe connecting the intermediate heat exchanger 107*b* and the valve 110*e*, and the refrigerant pipe connecting the valve 110*f* and each of the valves 1121*d*, 1122*d*, and 1123*d*.

The valves 112*na* to 112*nd* (n is a natural number not smaller than 2) switch the flow path of the secondary-side refrigerant sent to the indoor heat exchangers 108*n* of the indoor units C1 to C3. By adjusting the opening degree (opening area) of the valves 112*na* to 112*nd*, the flow rate of the secondary-side refrigerant flowing to the indoor heat exchangers 108*n* can be controlled.

(Configuration of Indoor Unit C)

The indoor units C1 to C3 include indoor heat exchangers 1081, 1082, and 1083, respectively. The indoor units C1 to C3 perform air conditioning by performing cooling or heating for the indoor space in which the indoor units C1 to C3 are provided.

The indoor heat exchangers 108*n* (n is a natural number not smaller than 2) function as a radiator in the heating operation and function as an evaporator in the cooling operation. The indoor heat exchangers 108*n* exchange heat between the indoor air supplied from a fan and the secondary-side refrigerant, and generates the heating air or cooling air to be supplied to the indoor space. The refrigerant pipe connected to one side of the indoor heat exchanger 1081 divides into branches, which are respectively connected to the valves 1121*a* and 1121*b*. The refrigerant pipe connected to the other side divides into branches, which are respectively connected to the valves 1121*c* and 1121*d*. The refrigerant pipe connected to one side of the indoor heat exchanger 1082 divides into branches, which are respectively connected to the valves 1122*a* and 1122*b*. The refrigerant pipe connected to the other side divides into branches, which are respectively connected to the valves 1122*c* and 1122*d*. The refrigerant pipe connected to one side of the indoor heat exchanger 1083 divides into branches, which are respectively connected to the valves 1123*a* and 1123*b*. The refrigerant pipe connected to the other side divides into branches, which are respectively connected to the valves 1123*c* and 1123*d*.

While the number of indoor units C connected is three in FIG. 7, this should not be construed restrictively. The number of indoor units C connected may be other than three.

The outdoor heat exchanger 104 and the indoor heat exchangers 108*n* correspond to the "heat source-side heat exchanger" and the "use-side heat exchangers", respectively, in the invention according to claim 1 of the present invention. The four-way valve 106, the valves 111*a* to 111*e*, the valves 110*a* to 110*h*, and the valves 112*na* to 112*nd* correspond to the "first flow switching means", the "second flow switching means", the "third flow switching means", and the "fourth flow switching means", respectively, in the invention according to claim 1 of the present invention.

Operation modes performed by the air-conditioning apparatus according to Embodiment 2 include a cooling only operation mode in which all of the indoor units C perform a cooling operation, a heating only operation mode in which all of the indoor units C perform a heating operation, a cooling main operation mode which allows a cooling operation or a heating operation to be selected for each individual indoor unit C and in which the cooling load is greater than the heating load, and a heating main operation mode which allows a cooling operation or a heating operation to be selected for each individual indoor unit C and in which the heating load is greater than the cooling load. Hereinafter, the operation modes will be described together with the flows of the primary-side refrigerant and secondary-side refrigerant.

(Cooling Only Operation Mode)

Figure 8:
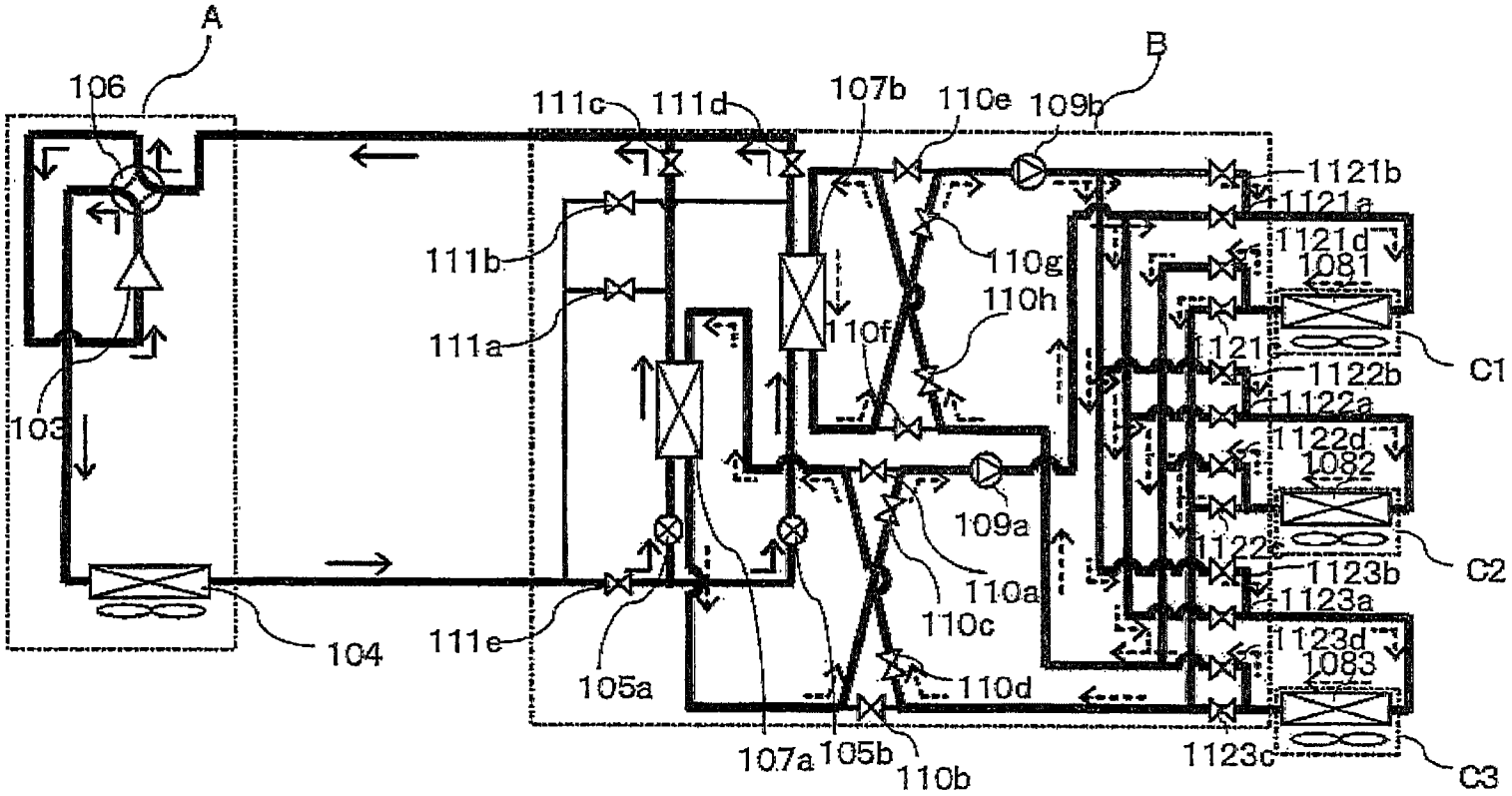
FIG. 8 is a refrigerant circuit diagram illustrating the flows of the primary-side refrigerant and secondary-side refrigerant in the cooling only operation mode of the air-conditioning apparatus according to Embodiment 2 of the present invention.

FIG. 8 is a refrigerant circuit diagram illustrating the flows of the primary-side refrigerant and secondary-side refrigerant in the cooling only operation mode of the air-conditioning apparatus according to Embodiment 2 of the present invention. In FIG. 8, pipes indicated by thick lines represent pipes through which the primary-side refrigerant and the secondary-side refrigerant flow. In FIG. 8, the flow direction of the primary-side refrigerant is indicated by solid arrows, and the flow direction of the secondary-side refrigerant is indicated by broken arrows. Hereinafter, the same applies to FIGS. 9 to 11. Hereinafter, the cooling only operation mode will be described with reference to FIG. 8.

In the primary-side refrigerant circuit, the four-way valve 106 is switched in advance so that the primary-side refrigerant discharged from the compressor 103 flows to the outdoor heat exchanger 104, and that the primary-side refrigerant that has flowed out of the relay unit B flows to the compressor 103, and the valves 111*a* and 111*b* are closed and the valves 111*c* to 111*e* are open. In the secondary-side refrigerant circuit, the valves 110*a*, 110*b*, 110*e*, and 110*f* are closed, the valves 110*c*, 110*d*, 110*g*, and 110*h* are open, and the valves 112*na* to 112*nd* are open.

First, the flow of the primary-side refrigerant in the primary-side refrigerant circuit will be described.

The primary-side refrigerant in a low-temperature, low-pressure gas state is compressed by the compressor 103, and discharged in a high-temperature, high-pressure state. The primary-side refrigerant flows into the outdoor heat exchanger 104 via the four-way valve 106, where the primary-side refrigerant radiates heat to the outdoor air, and a part or the entire primary-side refrigerant condenses and turns into a two-phase gas-liquid state or liquid state. The primary-side refrigerant in a two-phase gas-liquid state or liquid state that has flowed out of the outdoor heat exchanger 104 flows out of the outdoor unit A, and flows into the relay unit B.

After the primary-side refrigerant that has flowed into the relay unit B passes through the valve 111*e*, the primary-side refrigerant divides into branch flows. The branch flows flow into the expansion mechanisms 105*a* and 105*b*, undergo expansion and pressure reduction, turn into a two-phase gas-liquid state at low temperature and low pressure, and flow into the intermediate heat exchangers 107*a* and 107*b* in parallel, respectively. The flows of the primary-side refrigerant in a two-phase gas-liquid state that have flowed into the intermediate heat exchangers 107*a* and 107*b* absorb heat from the secondary-side refrigerant flowing in counterflow to the primary-side refrigerant, and evaporate and turn into a low-temperature, low-pressure gas state. The flows of the primary-side refrigerant that have flowed out of the intermediate heat exchangers 107*a* and 107*b* merge after passing through the valves 111*c* and 111*d*, respectively. The merged primary-side refrigerant flows out of the relay unit B, and flows into the outdoor unit A.

The primary-side refrigerant in a gas state that has flowed into the outdoor unit A is sucked into the compressor 103 via the four-way valve 106, and is compressed again.

Next, the flow of the secondary-side refrigerant in the secondary-side refrigerant circuit will be described.

The secondary-side refrigerant at low temperature sent out by driving of the pump 109*a* divides into branch flows. The branch flows flow out of the relay unit B after passing through the valves 1121*a*, 1122*a*, and 1123*a*, and flow into the indoor heat exchanger 1081 of the indoor unit C1, the indoor heat exchanger 1082 of the indoor unit C2, and the indoor heat exchanger 1083 of the indoor unit C3, respectively. The secondary-side refrigerant at low temperature sent out by driving of the pump 109*b* divides into branch flows. The branch flows flow out of the relay unit B after passing through the valves 1121*b*, 1122*b*, and 1123*b*, and flow into the indoor heat exchanger 1081 of the indoor unit C1, the indoor heat exchanger 1082 of the indoor unit C2, and the indoor heat exchanger 1083 of the indoor unit C3, respectively. The flows of the secondary-side refrigerant that have flowed into the indoor heat exchangers 1081, 1082, and 1083 cool the indoor air and turn into a high-temperature state, flow out of the indoor units C1, C2, and C3, respectively, and flow into the relay unit B.

One of the flows of the secondary-side refrigerant which has passed through the valve 1121*c* after flowing out of the indoor heat exchanger 1081, flowing into the relay unit B, and dividing into branch flows, one of the flows of the secondary-side refrigerant which has passed through the valve 1122*c* after flowing out of the indoor heat exchanger 1082, flowing into the relay unit B, and dividing into branch flows, and one of the flows of the secondary-side refrigerant which has passed through the valve 1123*c* after flowing out of the indoor heat exchanger 1083, flowing into the relay unit B, and dividing into branch flows, merge, and the merged secondary-side refrigerant flows into the intermediate heat exchanger 107*a* via the valve 110*d*. Also, the other flow of the secondary-side refrigerant which has passed through the valve 1121*d* after flowing out of the indoor heat exchanger 1081, flowing into the relay unit B, and dividing into branch flows, the other flow of the secondary-side refrigerant which has passed through the valve 1122*d* after flowing out of the indoor heat exchanger 1082, flowing into the relay unit B, and dividing into branch flows, and the other flow of the secondary-side refrigerant which has passed through the valve 1123*d* after flowing out of the indoor heat exchanger 1083, flowing into the relay unit B, and dividing into branch flows, merge, and the merged secondary-side refrigerant flows into the intermediate heat exchanger 107*b* via the valve 110*h*. The flows of the secondary-side refrigerant that have flowed into the intermediate heat exchangers 107*a* and 107*b* are cooled by the primary-side refrigerant in a low-temperature state flowing in counterflow to the secondary-side refrigerant, and flow into the intermediate heat exchangers 107*a* and 107*b*, respectively. The flows of the secondary-side refrigerant that have flowed out of the intermediate heat exchangers 107*a* and 107*b* flow into the pumps 109*a* and 109*b* via the valves 110*c* and 110*g*, respectively, and are sent out again.

(Heating Only Operation Mode)

Figure 9:
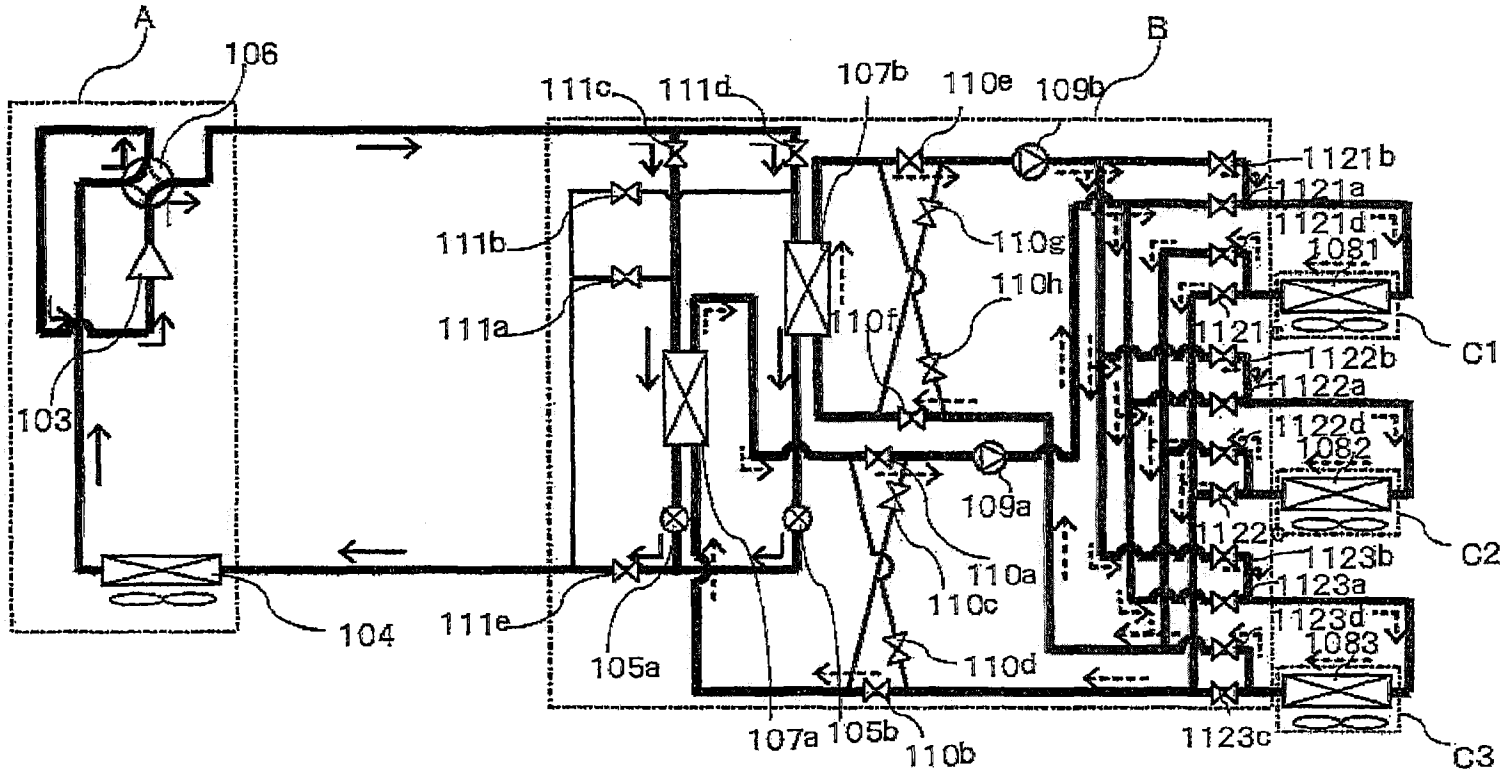
FIG. 9 is a refrigerant circuit diagram illustrating the flows of the primary-side refrigerant and secondary-side refrigerant in the heating only operation mode of the air-conditioning apparatus according to Embodiment 2 of the present invention.

FIG. 9 is a refrigerant circuit diagram illustrating the flows of the primary-side refrigerant and secondary-side refrigerant in the heating only operation mode of the air-conditioning apparatus according to Embodiment 2 of the present invention. Hereinafter, the heating only operation mode will be described with reference to FIG. 9.

In the primary-side refrigerant circuit, the four-way valve 106 is switched in advance so that the primary-side refrigerant discharged from the compressor 103 flows to the relay unit B, and that the primary-side refrigerant that has flowed out of the outdoor heat exchanger 104 flows to the compressor 103, and the valves 111*a* and 111*b* are closed and the valves 111*c* to 111*e* are open. In the secondary-side refrigerant circuit, the valves 110*a*, 110*b*, 110*e*, and 110*f* are open, the valves 110*c*, 110*d*, 110*g*, and 110*h* are closed, and the valves 112*na* to 112*nd* are open.

First, the flow of the primary-side refrigerant in the primary-side refrigerant circuit will be described.

The primary-side refrigerant in a low-temperature, low-pressure gas state is compressed by the compressor 103, and discharged in a high-temperature, high-pressure state. The primary-side refrigerant flows out of the outdoor unit A via the four-way valve 106, and flows into the relay unit B.

The primary-side refrigerant that has flowed into the relay unit B divides into branch flows, and the branch flows flow into the intermediate heat exchangers 107*a* and 107*b* in parallel via the valves 111*c* and 111*d*, respectively. The flows of the primary-side refrigerant in a high-temperature, high-pressure state that have flowed into the intermediate heat exchangers 107*a* and 107*b* radiate heat to the secondary-side refrigerant flowing in counterflow to the primary-side refrigerant, and a part or the entire primary-side refrigerant condenses and turns into a two-phase gas-liquid state or liquid state. The flows of the primary-side refrigerant in a two-phase gas-liquid state or liquid state that have flowed out of the intermediate heat exchangers 107*a* and 107*b* flow into the expansion mechanisms 105*a* and 105*b*, respectively, where the flows of the primary-side refrigerant are expanded and reduced in pressure and turn into a two-phase gas-liquid state at low temperature and low pressure, and then merge. The merged primary-side refrigerant flows out of the relay unit B via the valve 111*e*, and flows into the outdoor unit A.

The primary-side refrigerant in a two-phase gas-liquid state that have flowed into the outdoor unit A flows into the outdoor heat exchanger 104, absorbs heat from the outdoor air, and evaporates and turns into a low-temperature, low-pressure gas state. The primary-side refrigerant is sucked into the compressor 103 via the four-way valve 106, and is compressed again.

Next, the flow of the secondary-side refrigerant in the secondary-side refrigerant circuit will be described.

The secondary-side refrigerant at high temperature sent out by driving of the pump 109*a* divides into branch flows. The branch flows flow out of the relay unit B after passing through the valves 1121*a*, 1122*a*, and 1123*a*, and flow into the indoor heat exchanger 1081 of the indoor unit C1, the indoor heat exchanger 1082 of the indoor unit C2, and the indoor heat exchanger 1083 of the indoor unit C3, respectively. The secondary-side refrigerant at high temperature sent out by driving of the pump 109*b* divides into branch flows. The branch flows flow out of the relay unit B after passing through the valves 1121*b*, 1122*b*, and 1123*b*, and flow into the indoor heat exchanger 1081 of the indoor unit C1, the indoor heat exchanger 1082 of the indoor unit C2, and the indoor heat exchanger 1083 of the indoor unit C3, respectively. The flows of the secondary-side refrigerant that have flowed into the indoor heat exchangers 1081, 1082, and 1083 heat the indoor air and turn into a low-temperature state, flow out of the indoor units C1, C2, and C3, respectively, and flow into the relay unit B.

One of the flows of the secondary-side refrigerant which has passed through the valve 1121*c* after flowing out of the indoor heat exchanger 1081, flowing into the relay unit B, and dividing into branch flows, one of the flows of the secondary-side refrigerant which has passed through the valve 1122*c* after flowing out of the indoor heat exchanger 1082, flowing into the relay unit B, and dividing into branch flows, and one of the flows of the secondary-side refrigerant which has passed through the valve 1123*c* after flowing out of the indoor heat exchanger 1083, flowing into the relay unit B, and dividing into branch flows, merge, and the merged secondary-side refrigerant flows into the intermediate heat exchanger 107*a* via the valve 110*b*. Also, the other flow of the secondary-side refrigerant which has passed through the valve 1121*d* after flowing out of the indoor heat exchanger 1081, flowing into the relay unit B, and dividing into branch flows, the other flow of the secondary-side refrigerant which has passed through the valve 1122*d* after flowing out of the indoor heat exchanger 1082, flowing into the relay unit B, and dividing into branch flows, and the other flow of the secondary-side refrigerant which has passed through the valve 1123*d* after flowing out of the indoor heat exchanger 1083, flowing into the relay unit B, and dividing into branch flows, merge, and the merged secondary-side refrigerant flows into the intermediate heat exchanger 107*b* via the valve 110*f*. The flows of the secondary-side refrigerant that have flowed into the intermediate heat exchangers 107*a* and 107*b* are heated by the primary-side refrigerant in a high-temperature state flowing in counterflow to the secondary-side refrigerant, and flow out of the intermediate heat exchangers 107*a* and 107*b*, respectively. The flows of the secondary-side refrigerant that have flowed out of the intermediate heat exchangers 107*a* and 107*b* flow into the pumps 109*a* and 109*b* via the valves 110*a* and 110*e*, respectively, and are sent out again.

(Cooling Main Operation Mode)

Figure 10:
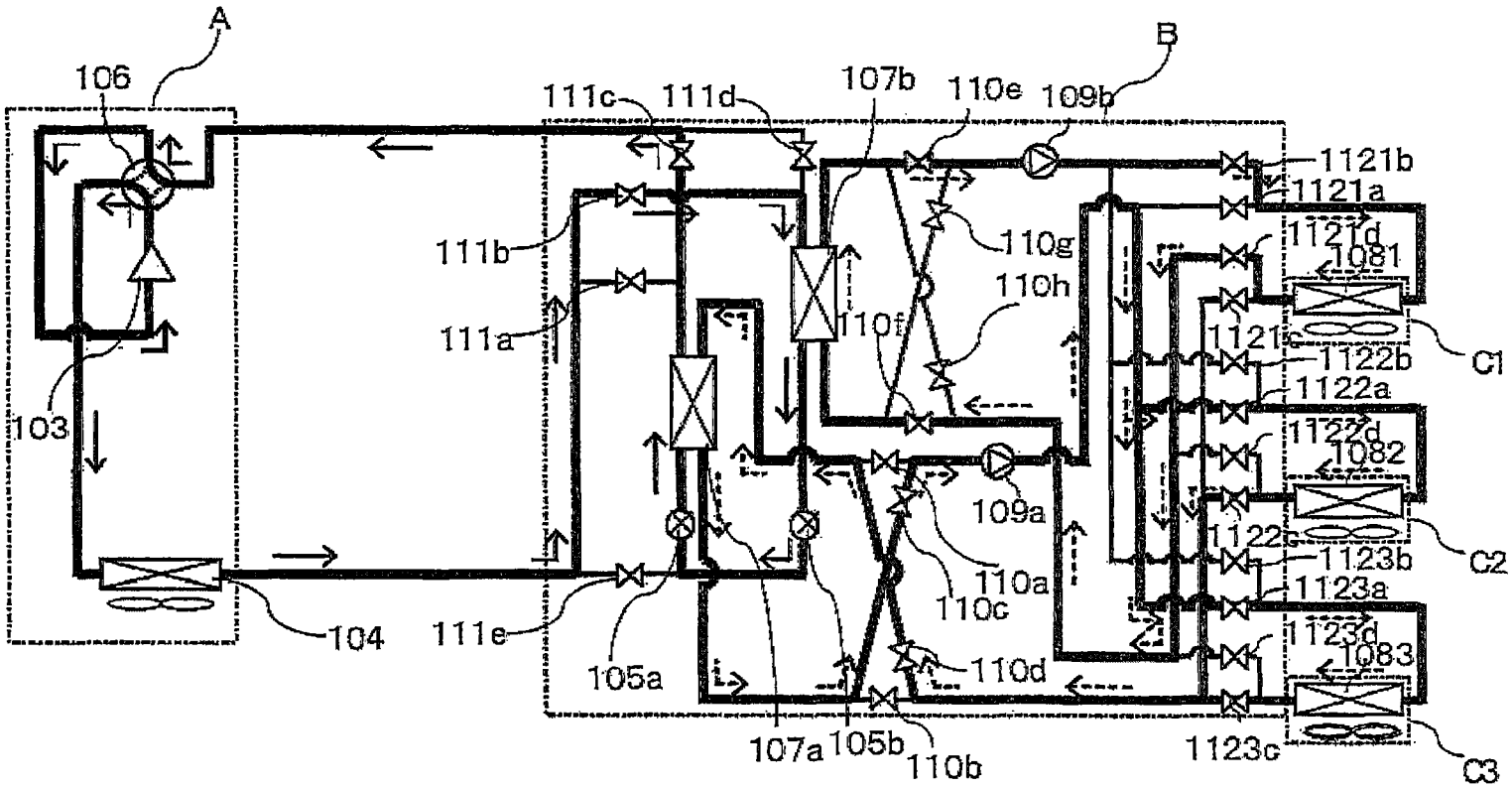
FIG. 10 is a refrigerant circuit diagram illustrating the flows of the primary-side refrigerant and secondary-side refrigerant in the cooling main operation mode of the air-conditioning apparatus according to Embodiment 2 of the present invention.

FIG. 10 is a refrigerant circuit diagram illustrating the flows of the primary-side refrigerant and secondary-side refrigerant in the cooling main operation mode of the air-conditioning apparatus according to Embodiment 2 of the present invention. Hereinafter, the cooling main operation mode will be described with reference to FIG. 10.

In FIG. 10, it is assumed that the indoor unit C1 performs a heating operation, and the indoor units C2 and C3 perform a refrigerating operation.

In the primary-side refrigerant circuit, the four-way valve 106 is switched in advance so that the primary-side refrigerant discharged from the compressor 103 flows to the outdoor heat exchanger 104, and that the primary-side refrigerant that has flowed out of the relay unit B flows to the compressor 103, and the valves 111*a*, 111*d*, and 111*e* are closed and the valves 111*b* and 111*c* are open. In the secondary-side refrigerant circuit, the valves 110*a*, 110*b*, 110*g*, and 110*h* are closed, and the valves 110*c*, 110*d*, 110*e*, and 110*f* are open. Further, the valves 1121*a*, 1121*c*, 1122*b*, 1122*d*, 1123*b*, and 1123*d* are closed, and the valves 1121*b*, 1121*d*, 1122*a*, 1122*c*, 1123*a*, and 1123*c* are open.

First, the flow of the primary-side refrigerant in the primary-side refrigerant circuit will be described.

The primary-side refrigerant in a low-temperature, low-pressure gas state is compressed by the compressor 103, and discharged in a high-temperature, high-pressure state. The primary-side refrigerant flows into the outdoor heat exchanger 104 via the four-way valve 106, where the primary-side refrigerant radiates heat to the outdoor air, and a part of the primary-side refrigerant condenses and turns into a two-phase gas-liquid state. The primary-side refrigerant in a two-phase gas-liquid state that has flowed out of the outdoor heat exchanger 104 flows out of the outdoor unit A, and flows into the relay unit B.

The primary-side refrigerant in a two-phase gas-liquid state that has flowed into the relay unit B flows into the intermediate heat exchanger 107*b* via the valve 111*b*, and further condenses as the primary-side refrigerant heats the secondary-side refrigerant flowing in counterflow to the primary-side refrigerant. As the secondary-side refrigerant that has flowed out of the intermediate heat exchanger 107*b* passes through the expansion mechanism 105*b* and the expansion mechanism 105*a*, the secondary-side refrigerant is expanded and reduced in pressure, turns into a two-phase gas-liquid state at low temperature and low pressure, and flows into the intermediate heat exchanger 107*a*. The primary-side refrigerant in a two-phase gas-liquid state that has flowed into the intermediate heat exchanger 107*a* absorbs heat from the secondary-side refrigerant flowing in counterflow to the primary-side refrigerant, and evaporates and turns into a low-temperature, low-pressure gas state. The primary-side refrigerant in a low-temperature, low-pressure gas state that has flowed out of the intermediate heat exchanger 107*a* flows out of the relay unit B via the valve 111*c*, and flows into the outdoor unit A.

The primary-side refrigerant in a gas state that has flowed into the outdoor unit A is sucked into the compressor 103 via the four-way valve 106, and is compressed again.

Next, the flow of the secondary-side refrigerant in the secondary-side refrigerant circuit will be described.

The secondary-side refrigerant at low temperature sent out by driving of the pump 109*a* divides into branch flows. The branch flows flow out of the relay unit B after passing through the valves 1122*a* and 1123*a*, and flow into the indoor heat exchanger 1082 of the indoor unit C2, and the indoor heat exchanger 1083 of the indoor unit C3, respectively. The flows of the secondary-side refrigerant that have flowed into the indoor heat exchangers 1082 and 1083 cool the indoor air and turn into a high-temperature state, flow out of the indoor units C2 and C3, respectively, and flow into the relay unit B.

The secondary-side refrigerant that has flowed out of the indoor heat exchanger 1082, flowed into the relay unit B, and passed through the valve 1122*c*, and the secondary-side refrigerant that has flowed out of the indoor heat exchanger 1083, flowed into the relay unit B, and passed through the valve 1123*c* merge, and the merged secondary-side refrigerant flows into the intermediate heat exchanger 107*a* via the valve 110*d*. The secondary-side refrigerant that has flowed into the intermediate heat exchanger 107*a* is cooled by the primary-side refrigerant in a low-temperature state flowing in counterflow to the secondary-side refrigerant, and flows out of the intermediate heat exchanger 107*a*. The secondary-side refrigerant that has flowed out of the intermediate heat exchanger 107*a* flows into the pump 109*a* via the valve 110*c*, and is sent out again.

The secondary-side refrigerant at high temperature sent out by driving of the pump 109*b* flows out of the relay unit B after passing through the valve 1121*b*, and flows into the indoor heat exchanger 1081 of the indoor unit C1. The secondary-side refrigerant that has flowed into the indoor heat exchanger 1081 heats the indoor air and turn into a low-temperature state, flow out of the indoor unit C1, and flows into the relay unit B.

The secondary-side refrigerant that has flowed out of the indoor heat exchanger 1081, flowed into the relay unit B, and passed through the valve 1121*d* flows into the intermediate heat exchanger 107*b* via the valve 110*f*. The secondary-side refrigerant that has flowed into the intermediate heat exchanger 107*b* is heated by the primary-side refrigerant in a high-temperature state flowing in counterflow to the secondary-side refrigerant, and flows out of the intermediate heat exchanger 107*b*. The secondary-side refrigerant that has flowed out of the intermediate heat exchanger 107*b* flows into the pump 109*b* via the valve 110*e*, and is sent out again.

(Heating Main Operation Mode)

Figure 11:
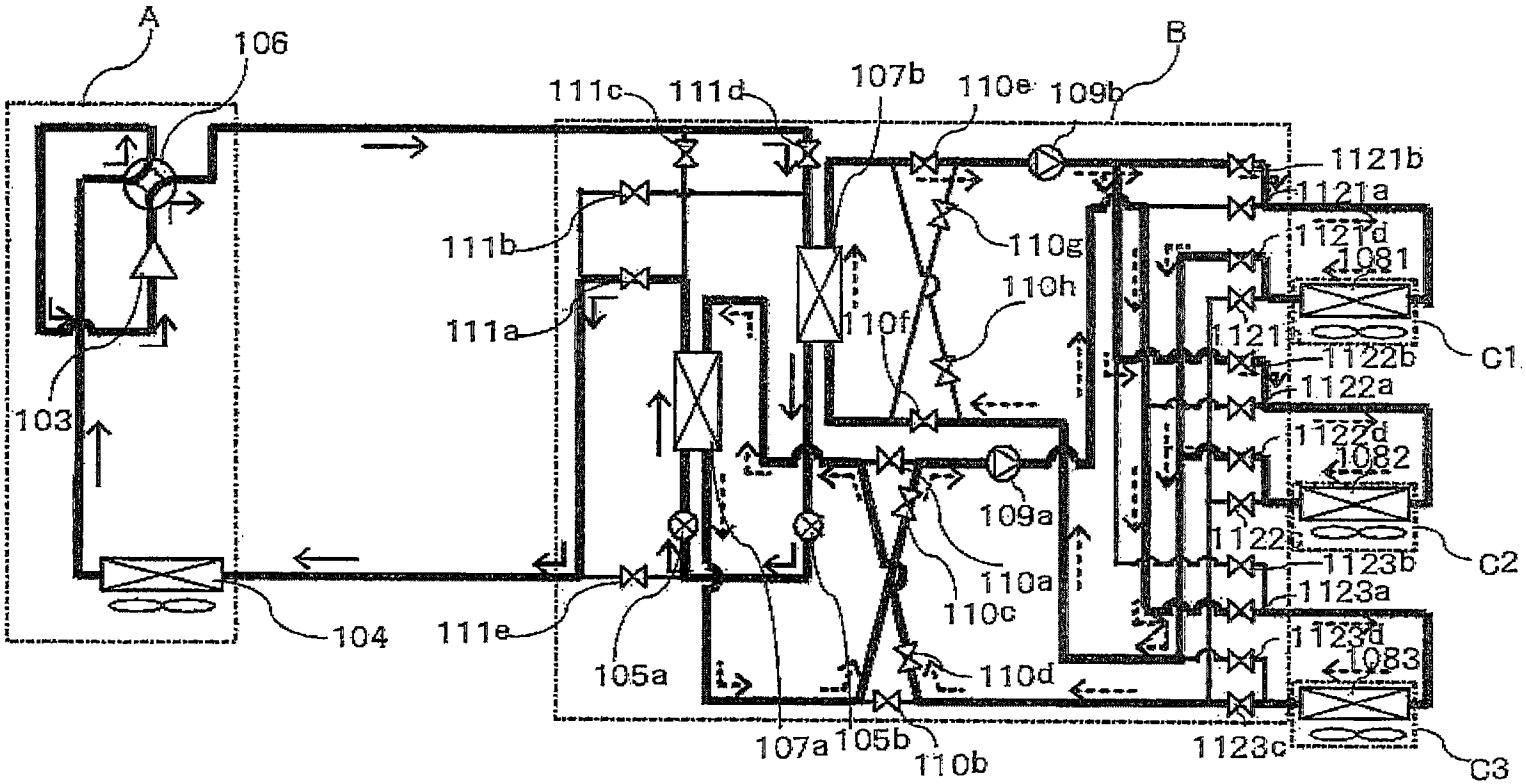
FIG. 11 is a refrigerant circuit diagram illustrating the flows of the primary-side refrigerant and secondary-side refrigerant in the heating main operation mode of the air-conditioning apparatus according to Embodiment 2 of the present invention.

FIG. 11 is a refrigerant circuit diagram illustrating the flows of the primary-side refrigerant and secondary-side refrigerant in the heating main operation mode of the air-conditioning apparatus according to Embodiment 2 of the present invention. Hereinafter, the heating main operation mode will be described with reference to FIG. 11. In FIG. 11, it is assumed that the indoor units C1 and C2 perform a heating operation, and the indoor unit C3 performs a refrigerating operation.

In the primary-side refrigerant circuit, the four-way valve 106 is switched in advance so that the primary-side refrigerant discharged from the compressor 103 flows to the relay unit B, and that the primary-side refrigerant that has flowed out of the outdoor heat exchanger 104 flows to the compressor 103, and the valves 111*a* and 111*d* are open and the valves 111*b*, 111*c*, and 111*e* are closed. In the secondary-side refrigerant circuit, the valves 110*a*, 110*b*, 110*g*, and 110*h* are closed, and the valves 110*c* to 110*f* are open. Further, the valves 1121*a*, 1121*c*, 1122*a*, 1122*c*, 1123*b*, and 1123*d* are closed, and the valves 1121*b*, 1121*d*, 1122*b*, 1122*d*, 1123*a*, and 1123*c* are open.

First, the flow of the primary-side refrigerant in the primary-side refrigerant circuit will be described.

The primary-side refrigerant in a low-temperature, low-pressure gas state is compressed by the compressor 103, and discharged in a high-temperature, high-pressure state. The primary-side refrigerant flows out of the outdoor unit A via the four-way valve 106, and flows into the relay unit B.

The primary-side refrigerant in a high-temperature, high-pressure state that has flowed into the relay unit B flows into the intermediate heat exchanger 107*b* via the valve 111*d*, radiates heat to the secondary-side refrigerant flowing in counterflow to the primary-side refrigerant, and a part or the entire primary-side refrigerant condenses and turns into a two-phase gas-liquid state or liquid state. As the secondary-side refrigerant that has flowed out of the intermediate heat exchanger 107*b* passes through the expansion mechanism 105*b* and the expansion mechanism 105*a*, the secondary-side refrigerant is expanded and reduced in pressure, turns into a two-phase gas-liquid state at low temperature and low pressure, and flows into the intermediate heat exchanger 107*a*. The primary-side refrigerant in a two-phase gas-liquid state that has flowed into the intermediate heat exchanger 107*a* absorbs heat from the secondary-side refrigerant flowing in counterflow to the primary-side refrigerant, and partially evaporates. The primary-side refrigerant that has flowed out of the intermediate heat exchanger 107*a* flows out of the relay unit B via the valve 111*a*, and flows into the outdoor unit A.

The primary-side refrigerant that has flowed into the outdoor unit A flows into the outdoor heat exchanger 104, absorbs heat from the indoor air, and evaporates and turns into a low-temperature, low-pressure gas state. The primary-side refrigerant is sucked into the compressor 103 via the four-way valve 106, and is compressed again.

Next, the flow of the secondary-side refrigerant in the secondary-side refrigerant circuit will be described.

The secondary-side refrigerant at low temperature sent out by driving of the pump 109*a* flows out of the relay unit B after passing through the valve 1123*a*, and flows into the indoor heat exchanger 1083 of the indoor unit C3. The secondary-side refrigerant that has flowed into the indoor heat exchanger 1083 cools the indoor air and turn into a high-temperature state, flows out of the indoor unit C3, and flows into the relay unit B.

The secondary-side refrigerant that has flowed out of the indoor heat exchanger 1083, flowed into the relay unit B, and passed through the valve 1123*c* flows into the intermediate heat exchanger 107*a* via the valve 110*d*. The secondary-side refrigerant that has flowed into the intermediate heat exchanger 107*a* is cooled by the primary-side refrigerant in a low-temperature state flowing in counterflow to the secondary-side refrigerant, and flows out of the intermediate heat exchanger 107*a*. The secondary-side refrigerant that has flowed out of the intermediate heat exchanger 107*a* flows into the pump 109*a* via the valve 110*a*, and is sent out again.

The secondary-side refrigerant at high temperature sent out by driving of the pump 109*b* divides into branch flows. The branch flows flow out of the relay unit B after passing through the valves 1121*b* and 1122*b*, and flow into the indoor heat exchanger 1081 of the indoor unit C1, and the indoor heat exchanger 1082 of the indoor unit C2, respectively. The flows of the secondary-side refrigerant that have flowed into the indoor heat exchangers 1081 and 1082 heat the indoor air and turn into a low-temperature state, flow out of the indoor units C1 and C2, respectively, and flow into the relay unit B.

The secondary-side refrigerant that has flowed out of the indoor heat exchanger 1081, flowed into the relay unit B, and passed through the valve 1121*d*, and the secondary-side refrigerant that has flowed out of the indoor heat exchanger 1082, flowed into the relay unit B, and passed through the valve 1122*d* merge, and the merged secondary-side refrigerant flows into the intermediate heat exchanger 107*b* via the valve 110*f*. The secondary-side refrigerant that has flowed into the intermediate heat exchanger 107*b* is heated by the primary-side refrigerant in a high-temperature state flowing in counterflow to the secondary-side refrigerant, and flows out of the intermediate heat exchanger 107*b*. The secondary-side refrigerant that has flowed out of the intermediate heat exchanger 107*b* flows into the pump 109*b* via the valve 110*e*, and is sent out again.

Advantageous Effects of Embodiment 2

According to the configuration and the operation mentioned above, in any operation mode, the primary-side refrigerant and the secondary-side refrigerant flow in counterflow directions in both of the intermediate heat exchangers 107*a* and 107*b*. Therefore, thermal effect of the primary-side refrigerant and the secondary-side refrigerant is efficiently exerted, thereby making it possible to reduce the input to each of the pumps 109*a* and 109*b*.

In a case where a refrigerant whose discharge pressure is higher than the critical point is used as the primary-side refrigerant, the discharge temperature of the refrigerant is higher than that of a refrigerant whose discharge pressure is lower than the critical point, and the refrigerant does not become a two-phase gas-liquid state. Therefore, the target value of the outlet-inlet temperature difference of the secondary-side refrigerant within the intermediate heat exchanger can be set to a large value, thereby making it possible to reduce the input to the pump.

In a case where a zeotropic refrigerant mixture is used as the primary-side refrigerant, because a zeotropic refrigerant mixture undergoes a temperature change when its phase changes, as compared with a case where a single refrigerant or azeotropic refrigerant mixture that does not undergo a temperature change when its phase changes is used, heat exchange can be performed efficiently when the primary-side refrigerant and the secondary-side refrigerant are made to flow in counterflow directions in the intermediate heat exchanger.

As for the four valves 110*a* to 110*d* used to switch the direction of the secondary-side refrigerant flowing into the intermediate heat exchanger 107*a*, and the four valves 110*e* to 110*h* used to switch the direction of the secondary-side refrigerant flowing into the intermediate heat exchanger 107*b*, as another means, two three-way valves or one four-way valve may be used to form a circuit for switching the flow path direction. In this case, it is possible to reduce the number of components.

As for the valves 112*na* and 112*nb* used to switch the direction of the secondary-side refrigerant flowing into the indoor heat exchangers 108*n* as well, as another means, these valves may be configured as one three-way valve, in which case it is possible to reduce the number of components. The same applies to the valves 112*nc* and 112*nd* used to switch the direction of the secondary-side refrigerant that has flowed out of the indoor heat exchangers 108*n*.

Embodiment 3

An air-conditioning apparatus according to Embodiment 3 will be described while mainly focusing on differences from the air-conditioning apparatus according to Embodiment 2.

(Configuration of Air-Conditioning Apparatus)

Figure 12:
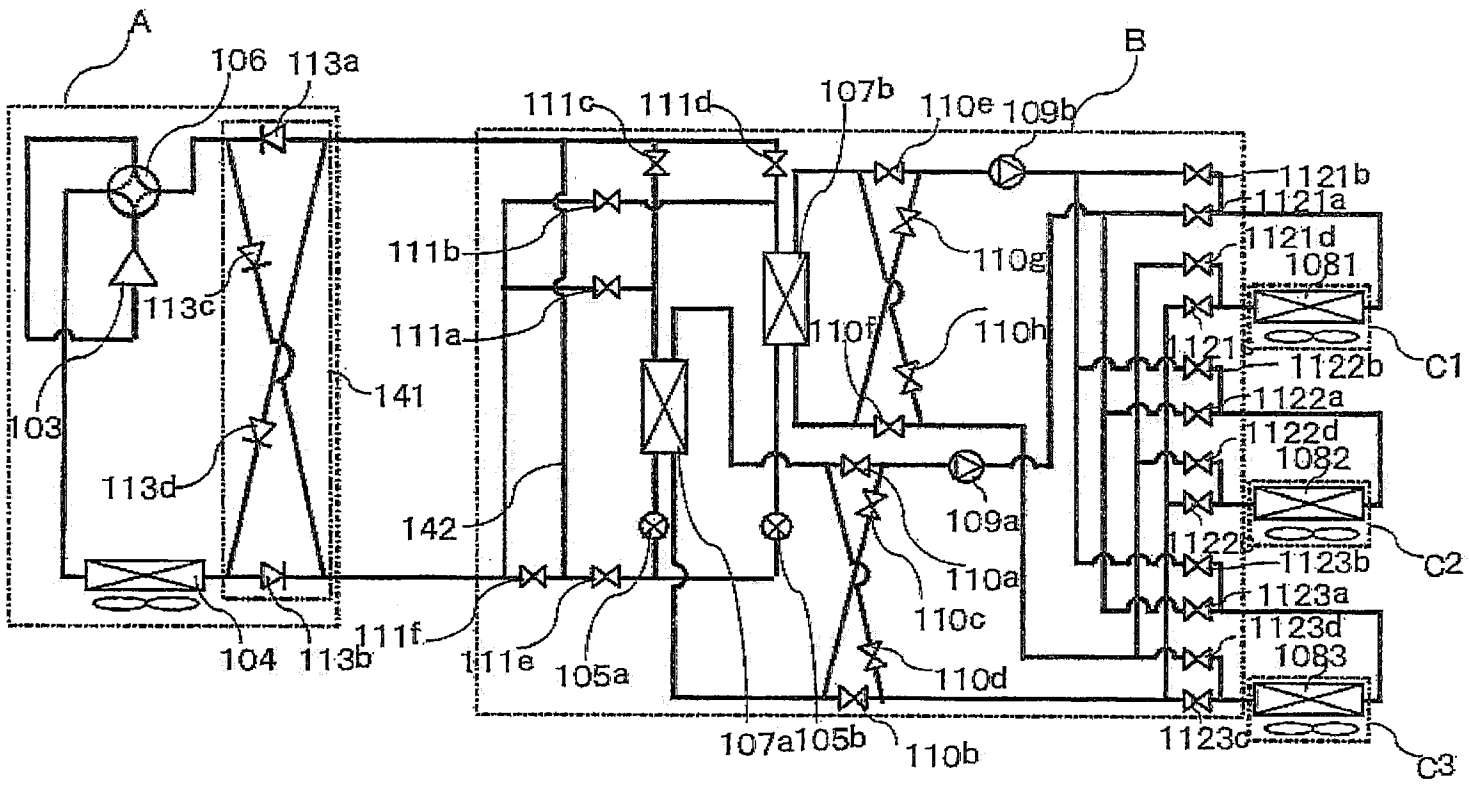
FIG. 12 is a schematic diagram of an air-conditioning apparatus according to Embodiment 3 of the present invention.

FIG. 12 is a schematic diagram of an air-conditioning apparatus according to Embodiment 3 of the present invention.

As illustrated in FIG. 12, the outdoor unit A includes the compressor 103, the outdoor heat exchanger 104, the four-way valve 106, and a flow switching unit 141 including check valves 113*a* to 113*d*.

As will be described later, the flow switching unit 141 including the check valves 113*a* to 113*d* has the function of causing the primary-side refrigerant flowing within the refrigerant pipes connecting the outdoor unit A and the relay unit B to flow in a certain direction. The check valve 113*a* is provided in the refrigerant pipe connecting the four-way valve 106 and each of the valves 111*c* and 111*d*, and causes the primary-side refrigerant to flow only in a direction from each of the valves 111*c* and 111*d* toward the four-way valve 106. The check valve 113*b* is provided in the refrigerant pipe connecting the outdoor heat exchanger 104 and the valve 111*f* described later, and causes the primary-side refrigerant to flow only in a direction from the outdoor heat exchanger 104 toward the valve 111*f*. The check valve 113*c* is provided in the refrigerant pipe that connects between the refrigerant pipe connecting the four-way valve 106 and the check valve 113*a*, and the refrigerant pipe connecting the check valve 113*b* and the valve 111*f*, and causes the primary-side refrigerant to flow only in a direction from the refrigerant pipe connecting the four-way valve 106 and the check valve 113*a* toward the refrigerant pipe connecting the check valve 113*b* and the valve 111*f*. The check valve 113*d* is provided in the refrigerant pipe that connects between the refrigerant pipe connecting the check valve 113*a* and each of the valves 111*c* and 111*d*, and the refrigerant pipe connecting the indoor heat exchanger 104 and the check valve 113*b*, and causes the primary-side refrigerant to flow only in a direction from the refrigerant pipe connecting the check valve 113*a* and each of the valves 111*c* and 111*d* toward the refrigerant pipe connecting the indoor heat exchanger 104 and the check valve 113*b*.

The relay unit B includes the intermediate heat exchangers 107*a* and 107*b*, the expansion mechanisms 105*a* and 105*b*, the pumps 109*a* and 109*b*, the valves 110*a* to 110*h*, 111*a* to 111*f*, and 112*na* to 112*nd*, and a bypass pipe 142.

The valve 111*f* is configured by a two-way valve or the like. The valve 111*f* is provided in the refrigerant pipe between the valve 111*e*, and the point where the refrigerant pipe into which refrigerant pipes connected to the valves 111*a* and 111*b* merge connects with the refrigerant pipe connecting the check valve 113*b* and the valve 111*e*.

The bypass pipe 142 is a refrigerant pipe that connects between the refrigerant pipe connecting the check valve 113*a* and each of the valves 111*c* and 111*d*, and the refrigerant pipe connecting the valve 111*e* and the valve 111*f*.

Hereinafter, operation modes will be described together with the flow of the primary-side refrigerant.

The flow of the secondary-side refrigerant is the same as that in Embodiment 1.

(Cooling Only Operation Mode)

Figure 13:
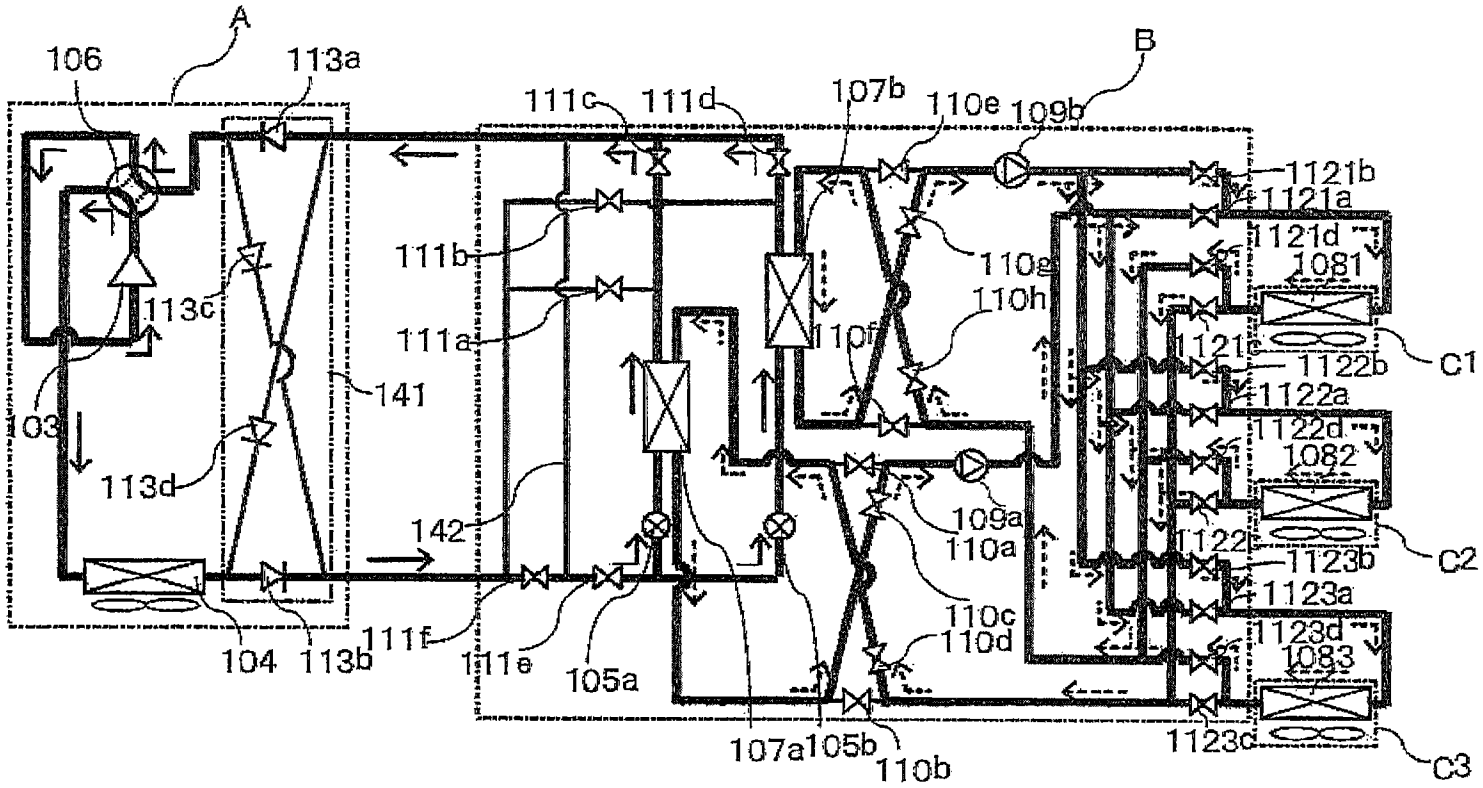
FIG. 13 is a refrigerant circuit diagram illustrating the flows of the primary-side refrigerant and secondary-side refrigerant in the cooling only operation mode of the air-conditioning apparatus according to Embodiment 3 of the present invention.

FIG. 13 is a refrigerant circuit diagram illustrating the flows of the primary-side refrigerant and secondary-side refrigerant in the cooling only operation mode of the air-conditioning apparatus according to Embodiment 3 of the present invention. In FIG. 13, pipes indicated by thick lines represent pipes through which the primary-side refrigerant and the secondary-side refrigerant flow. In FIG. 13, the flow direction of the primary-side refrigerant is indicated by solid arrows, and the flow direction of the secondary-side refrigerant is indicated by broken arrows. Hereinafter, the same applies to FIGS. 14 to 16. Hereinafter, the cooling only operation mode will be described with reference to FIG. 13.

In the primary-side refrigerant circuit, the four-way valve 106 is switched in advance so that the primary-side refrigerant discharged from the compressor 103 flows to the outdoor heat exchanger 104, and that the primary-side refrigerant that has flowed out of the relay unit B flows to the compressor 103, and the valves 111*a* and 111*b* are closed and the valves 111*c* to 111*f* are open. In the secondary-side refrigerant circuit, the valves 110*a*, 110*b*, 110*e*, and 110*f* are closed, the valves 110*c*, 110*d*, 110*g*, and 110*h* are open, and the valves 112*na* to 112*nd* are open.

As described above, only the flow of the primary-side refrigerant in the primary-side refrigerant circuit will be described.

The primary-side refrigerant in a low-temperature, low-pressure gas state is compressed by the compressor 103, and discharged in a high-temperature, high-pressure state. The primary-side refrigerant flows into the outdoor heat exchanger 104 via the four-way valve 106, where the primary-side refrigerant radiates heat to the outdoor air, and a part or the entire primary-side refrigerant condenses and turns into a two-phase gas-liquid state or liquid state. The primary-side refrigerant in a two-phase gas-liquid state or liquid state that has flowed out of the outdoor heat exchanger 104 flows out of the outdoor unit A via the check valve 113*b*, and flows into the relay unit B.

After the primary-side refrigerant that has flowed into the relay unit B passes through the valves 111*f* and the valve 111*e*, the primary-side refrigerant divides into branch flows. The branch flows flow into the expansion mechanisms 105*a* and 105*b*, undergo expansion and pressure reduction, turn into a two-phase gas-liquid state at low temperature and low pressure, and flow into the intermediate heat exchangers 107*a* and 107*b* in parallel, respectively. The flows of the primary-side refrigerant in a two-phase gas-liquid state that have flowed into the intermediate heat exchangers 107*a* and 107*b* absorb heat from the secondary-side refrigerant flowing in counterflow to the primary-side refrigerant, and evaporate and turn into a low-temperature, low-pressure gas state. The flows of the primary-side refrigerant that have flowed out of the intermediate heat exchangers 107*a* and 107*b* merge after passing through the valves 111*c* and 111*d*, respectively. The merged primary-side refrigerant flows out of the relay unit B, and flows into the outdoor unit A.

The primary-side refrigerant in a gas state that has flowed into the outdoor unit A is sucked into the compressor 103 via the check valve 113*a* and the four-way valve 106, and is compressed again.

(Heating Only Operation Mode)

Figure 14:
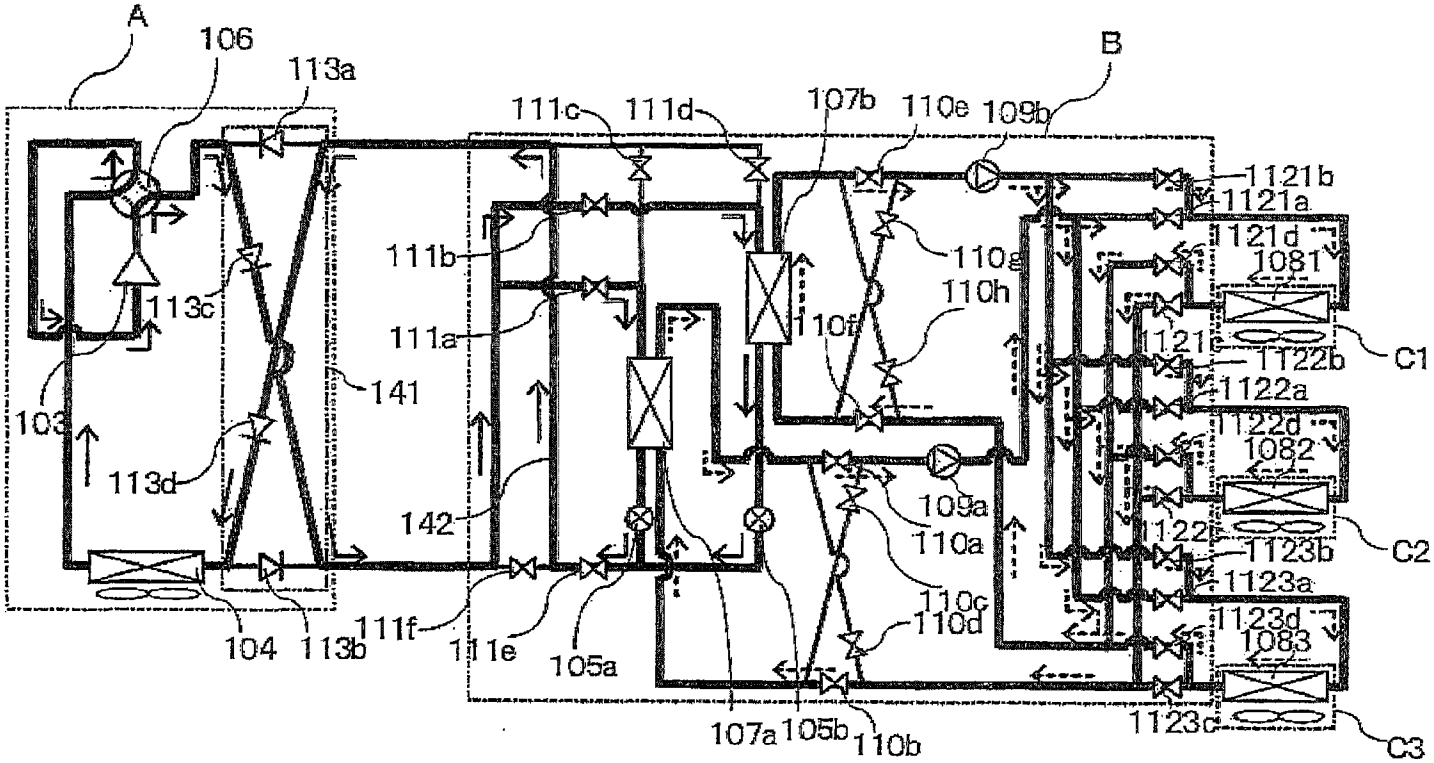
FIG. 14 is a refrigerant circuit diagram illustrating the flows of the primary-side refrigerant and secondary-side refrigerant in the heating only operation mode of the air-conditioning apparatus according to Embodiment 3 of the present invention.

FIG. 14 is a refrigerant circuit diagram illustrating the flows of the primary-side refrigerant and secondary-side refrigerant in the heating only operation mode of the air-conditioning apparatus according to Embodiment 3 of the present invention. Hereinafter, the heating only operation mode will be described with reference to FIG. 14.

In the primary-side refrigerant circuit, the four-way valve 106 is switched in advance so that the primary-side refrigerant discharged from the compressor 103 flows to the relay unit B, and that the primary-side refrigerant that has flowed out of the outdoor heat exchanger 104 flows to the compressor 103, and the valves 111*a*, 111*b*, and 111*e* are open and the valves 111*c*, 111*d*, and 111*f* are closed. In the secondary-side refrigerant circuit, the valves 110*a*, 110*b*, 110*e*, and 110*f* are open, the valves 110*c*, 110*d*, 110*g*, and 110*h* are closed, and the valves 112*na* to 112*nd* are open.

As described above, only the flow of the primary-side refrigerant in the primary-side refrigerant circuit will be described.

The primary-side refrigerant in a low-temperature, low-pressure gas state is compressed by the compressor 103, and discharged in a high-temperature, high-pressure state. The primary-side refrigerant flows out of the outdoor unit A via the four-way valve 106 and the check valve 113*c*, and flows into the relay unit B.

The primary-side refrigerant that has flowed into the relay unit B divides into branch flows, and the branch flows flow into the intermediate heat exchangers 107*a* and 107*b* in parallel via the valves 111*a* and 111*b*, respectively. The flows of the primary-side refrigerant in a high-temperature, high-pressure state that have flowed into the intermediate heat exchangers 107*a* and 107*b* radiate heat to the secondary-side refrigerant flowing in counterflow to the primary-side refrigerant, and a part or the entire primary-side refrigerant condenses and turns into a two-phase gas-liquid state or liquid state. The flows of the primary-side refrigerant in a two-phase gas-liquid state or liquid state that have flowed out of the intermediate heat exchangers 107*a* and 107*b* flow into the expansion mechanisms 105*a* and 105*b*, respectively, undergo expansion and pressure reduction, turn into a two-phase gas-liquid state at low temperature and low pressure, and then merge. The merged primary-side refrigerant passes through the valve 111*e*, and flows out of the relay unit B after flowing through the bypass pipe 142, and flows into the outdoor unit A.

The primary-side refrigerant in a two-phase gas-liquid state that have flowed into the outdoor unit A flows into the outdoor heat exchanger 104 via the check valve 113*d*, absorbs heat from the outdoor air, and evaporates and turns into a low-temperature, low-pressure gas state. The primary-side refrigerant is sucked into the compressor 103 via the four-way valve 106, and is compressed again.

(Cooling Main Operation Mode)

Figure 15:
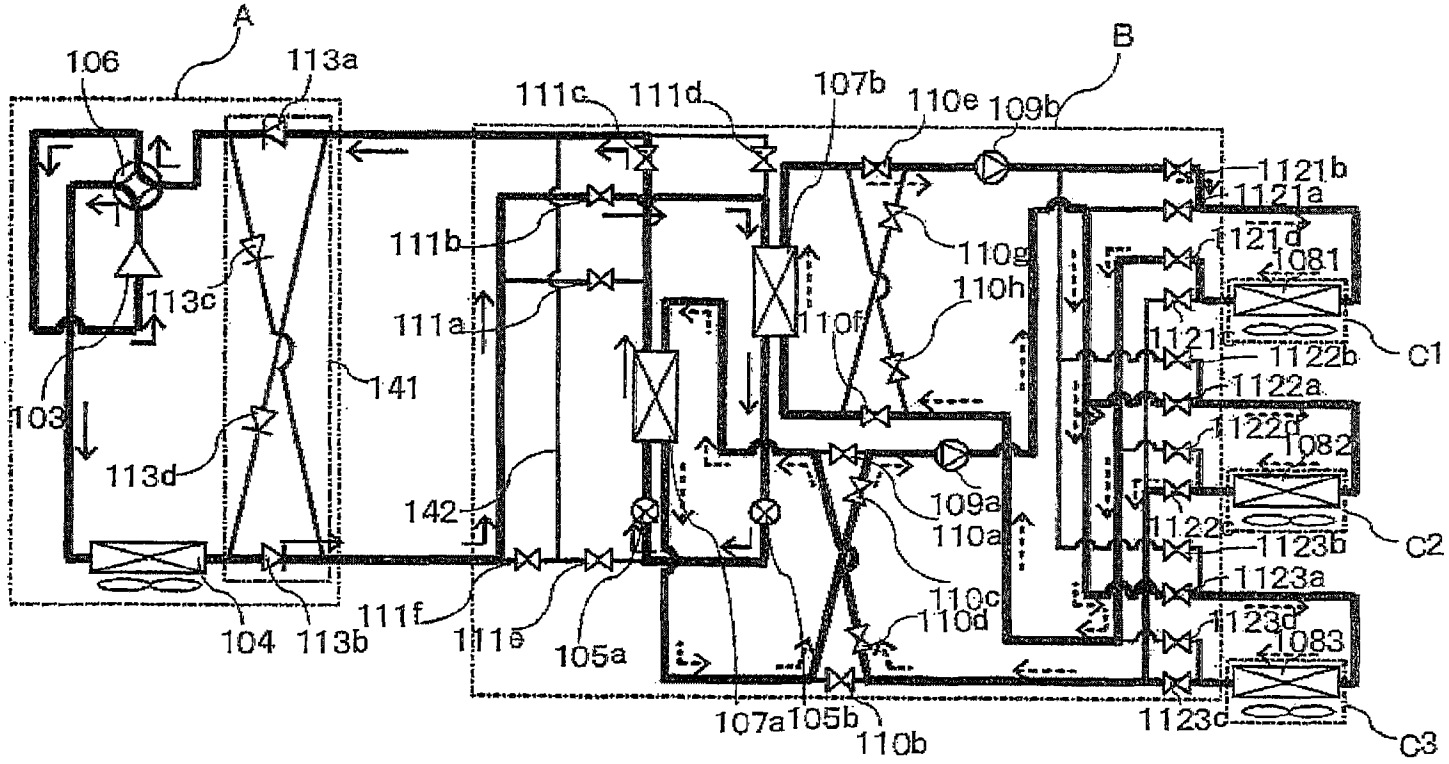
FIG. 15 is a refrigerant circuit diagram illustrating the flows of the primary-side refrigerant and secondary-side refrigerant in the cooling main operation mode of the air-conditioning apparatus according to Embodiment 3 of the present invention.

FIG. 15 is a refrigerant circuit diagram illustrating the flows of the primary-side refrigerant and secondary-side refrigerant in the cooling main operation mode of the air-conditioning apparatus according to Embodiment 3 of the present invention. Hereinafter, the cooling main operation mode will be described with reference to FIG. 15. In FIG. 15, it is assumed that the indoor unit C1 performs a heating operation, and the indoor units C2 and C3 perform a cooling operation.

In the primary-side refrigerant circuit, the four-way valve 106 is switched in advance so that the primary-side refrigerant discharged from the compressor 103 flows to the outdoor heat exchanger 104, and that the primary-side refrigerant that has flowed out of the relay unit B flows to the compressor 103, and the valves 111*a*, 111*d*, 111*e*, and 111*f* are closed and the valves 111*b* and 111*c* are open. In the secondary-side refrigerant circuit, the valves 110*a*, 110*b*, 110*g*, and 110*h* are closed, and the valves 110*c*, 110*d*, 110*e*, and 110*f* are open. Further, the valves 1121*a*, 1121*c*, 1122*b*, 1122*d*, 1123*b*, and 1123*d* are closed, and the valves 1121*b*, 1121*d*, 1122*a*, 1122*c*, 1123*a*, and 1123*c* are open.

As described above, only the flow of the primary-side refrigerant in the primary-side refrigerant circuit will be described.

The primary-side refrigerant in a low-temperature, low-pressure gas state is compressed by the compressor 103, and discharged in a high-temperature, high-pressure state. The primary-side refrigerant flows into the outdoor heat exchanger 104 via the four-way valve 106, where the primary-side refrigerant radiates heat to the outdoor air, and a part of the primary-side refrigerant condenses and turns into a two-phase gas-liquid state. The primary-side refrigerant in a two-phase gas-liquid state that has flowed out of the outdoor heat exchanger 104 flows out of the outdoor unit A via the check valve 113*b*, and flows into the relay unit B.

The primary-side refrigerant in a two-phase gas-liquid state that has flowed into the relay unit B flows into the intermediate heat exchanger 107*b* via the valve 111*b*, and further condenses as the primary-side refrigerant heats the secondary-side refrigerant flowing in counterflow to the primary-side refrigerant. As the secondary-side refrigerant that has flowed out of the intermediate heat exchanger 107*b* passes through the expansion mechanism 105*b* and the expansion mechanism 105*a*, the secondary-side refrigerant is expanded and reduced in pressure, turns into a two-phase gas-liquid state at low temperature and low pressure, and flows into the intermediate heat exchanger 107*a*. The primary-side refrigerant in a two-phase gas-liquid state that has flowed into the intermediate heat exchanger 107*a* absorbs heat from the secondary-side refrigerant flowing in counterflow to the primary-side refrigerant, and evaporates and turns into a low-temperature, low-pressure gas state. The primary-side refrigerant in a low-temperature, low-pressure gas state that has flowed out of the intermediate heat exchanger 107*a* flows out of the relay unit B via the valve 111*c*, and flows into the outdoor unit A.

The primary-side refrigerant in a gas state that has flowed into the outdoor unit A is sucked into the compressor 103 via the check valve 113*a* and the four-way valve 106, and is compressed again.

(Heating Main Operation Mode)

Figure 16:
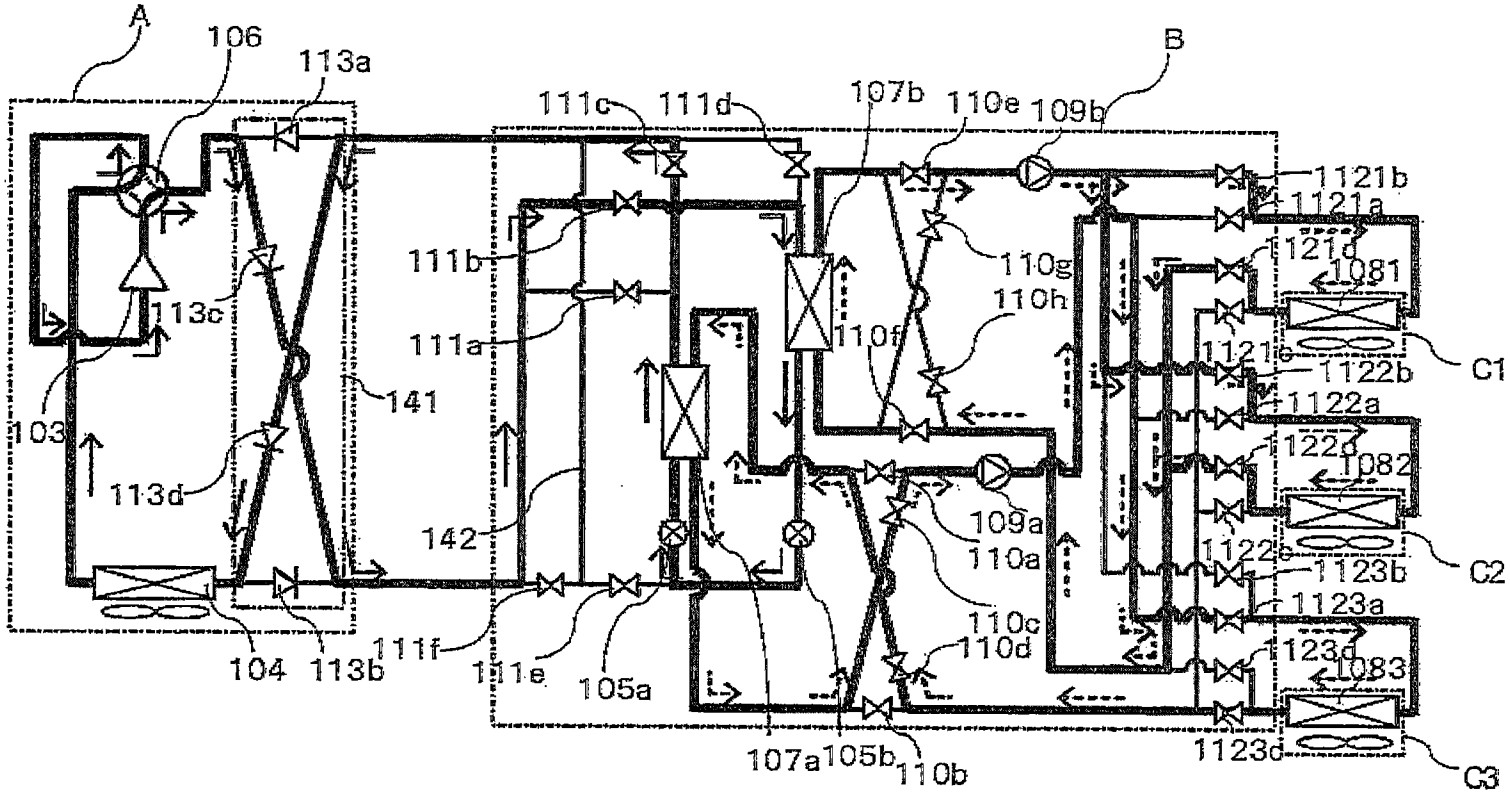
FIG. 16 is a refrigerant circuit diagram illustrating the flows of the primary-side refrigerant and secondary-side refrigerant in the heating main operation mode of the air-conditioning apparatus according to Embodiment 3 of the present invention.

FIG. 16 is a refrigerant circuit diagram illustrating the flows of the primary-side refrigerant and secondary-side refrigerant in the heating main operation mode of the air-conditioning apparatus according to Embodiment 3 of the present invention. Hereinafter, the heating main operation mode will be described with reference to FIG. 16. In FIG. 16, it is assumed that the indoor units C1 and C2 perform a heating operation, and the indoor unit C3 performs a cooling operation.

In the primary-side refrigerant circuit, the four-way valve 106 is switched in advance so that the primary-side refrigerant discharged from the compressor 103 flows to the relay unit B, and that the primary-side refrigerant that has flowed out of the outdoor heat exchanger 104 flows to the compressor 103, and the valves 111*a*, and 111*d* to 111*f* are closed and the valves 111*b* and 111*c* are open. In the secondary-side refrigerant circuit, the valves 110*a*, 110*b*, 110*g*, and 110*h* are closed, and the valves 110*c* to 110*f* are open. Further, the valves 1121*a*, 1121*c*, 1122*a*, 1122*c*, 1123*b*, and 1123*d* are closed, and the valves 1121*b*, 1121*d*, 1122*b*, 1122*d*, 1123*a*, and 1123*c* are open.

As described above, only the flow of the primary-side refrigerant in the primary-side refrigerant circuit will be described.

The primary-side refrigerant in a low-temperature, low-pressure gas state is compressed by the compressor 103, and discharged in a high-temperature, high-pressure state. The primary-side refrigerant flows out of the outdoor unit A via the four-way valve 106 and the check valve 113*c*, and flows into the relay unit B.

The primary-side refrigerant in a high-temperature, high-pressure state that has flowed into the relay unit B flows into the intermediate heat exchanger 107*b* via the valve 111*b*, radiates heat to the secondary-side refrigerant flowing in counterflow to the primary-side refrigerant, and a part or the entire primary-side refrigerant condenses and turns into a two-phase gas-liquid state or liquid state. As the secondary-side refrigerant that has flowed out of the intermediate heat exchanger 107*b* passes through the expansion mechanism 105*b* and the expansion mechanism 105*a*, the secondary-side refrigerant is expanded and reduced in pressure, turns into a two-phase gas-liquid state at low temperature and low pressure, and flows into the intermediate heat exchanger 107*a*. The primary-side refrigerant in a two-phase gas-liquid state that has flowed into the intermediate heat exchanger 107*a* absorbs heat from the secondary-side refrigerant flowing in counterflow to the primary-side refrigerant, and partially evaporates. The primary-side refrigerant that has flowed out of the intermediate heat exchanger 107*a* flows out of the relay unit B via the valve 111*c*, and flows into the outdoor unit A.

The primary-side refrigerant that has flowed into the outdoor unit A flows into the outdoor heat exchanger 104 via the check valve 113*d*, absorbs heat from the indoor air, and evaporates and turns into a low-temperature, low-pressure gas state. The primary-side refrigerant is sucked into the compressor 103 via the four-way valve 106, and is compressed again.

Advantageous Effects of Embodiment 3

According to the configuration and the operation mentioned above, irrespective of the operation mode, the primary-side refrigerant flowing through the refrigerant pipes connecting the outdoor unit A and the relay unit B flow in a certain direction, and the refrigerant pipes through which a high-pressure refrigerant and a low-pressure refrigerant flow become fixed. Consequently, of the refrigerant pipes connecting the outdoor unit A and the relay unit B, the wall thickness of the refrigerant pipe through which the low-pressure refrigerant flows can be reduced, thereby enabling cost reduction.

Embodiment 4

An air-conditioning apparatus according to Embodiment 4 will be described while mainly focusing on differences from the air-conditioning apparatus according to Embodiment 2.

(Configuration of Air-Conditioning Apparatus)

Figure 17:
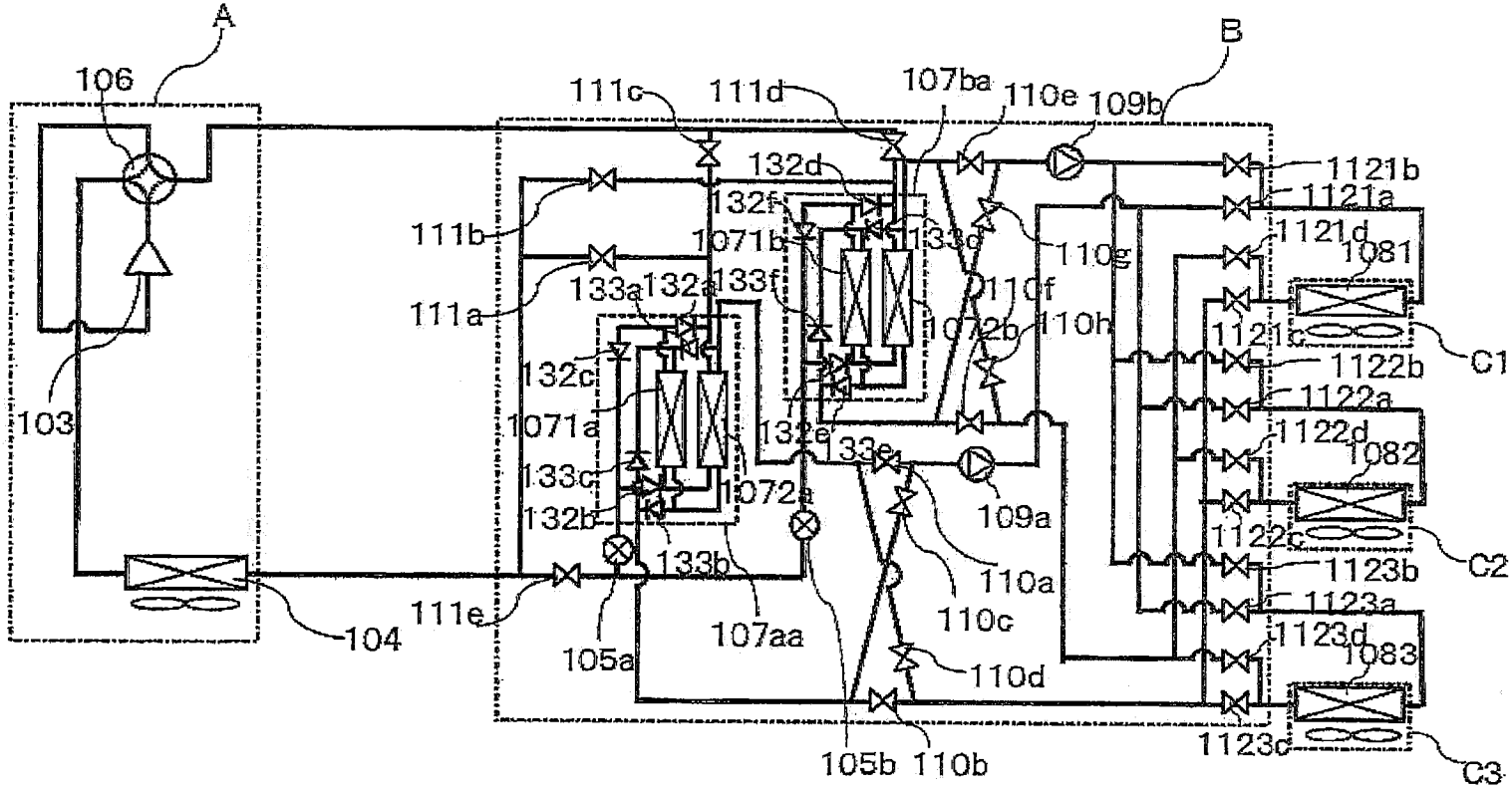
FIG. 17 is a schematic diagram of an air-conditioning apparatus according to Embodiment 4 of the present invention.

FIG. 17 is a schematic diagram of an air-conditioning apparatus according to Embodiment 4 of the present invention.

As illustrated in FIG. 17, in the air-conditioning apparatus according to Embodiment 4, the intermediate heat exchangers 107*a* and 107*b* in the air-conditioning apparatus according to Embodiment 2 are replaced by intermediate heat exchangers 107*aa* and 107*ba*, respectively. The intermediate heat exchangers 107*aa* and 107*ba* are both configured in the same manner as the intermediate heat exchanger 7 in the air-conditioning apparatus according to Embodiment 1.

First, heat transfer units 1071*a* and 1072*a*, and check valves 132*a* to 132*c* and 133*a* to 133*c* in the intermediate heat exchanger 107*aa* correspond to the heat transfer units 7*a* and 7*b*, and the check valves 11*a* to 11*c* and 12*a* to 12*c* in the intermediate heat exchanger 7 in Embodiment 1, respectively. Heat transfer units 1071*b* and 1072*b*, and check valves 132*d* to 132*f* and 133*d* to 133*f* in the intermediate heat exchanger 107*ba* correspond to the heat transfer units 7*a* and 7*b*, and the check valves 11*a* to 11*c* and 12*a* to 12*c* in the intermediate heat exchanger 7 in Embodiment 1, respectively.

The operation of the air-conditioning apparatus according to Embodiment 4 is the same as that of the air-conditioning apparatus according to Embodiment 2, except for the flow of refrigerant within each of the intermediate heat exchangers 107*aa* and 107*ba*. Moreover, provided that the primary-side refrigerant and the secondary-side refrigerant flow out of and flow into the intermediate heat exchanger 107*aa* and the intermediate heat exchanger 107*ba* in the same direction, the operations in the intermediate heat exchanger 107*aa* and the intermediate heat exchanger 107*ba* are the same. Accordingly, hereinafter, the operation in the intermediate heat exchanger 107*ba* will be described.

The check valves 132*a* to 132*f* and 133*a* to 133*f* correspond to the "fifth flow switching means" in the invention according to claim 5 of the present invention.

(Operation of Intermediate Heat Exchanger 107*Ba* as Evaporator)

Figure 18:
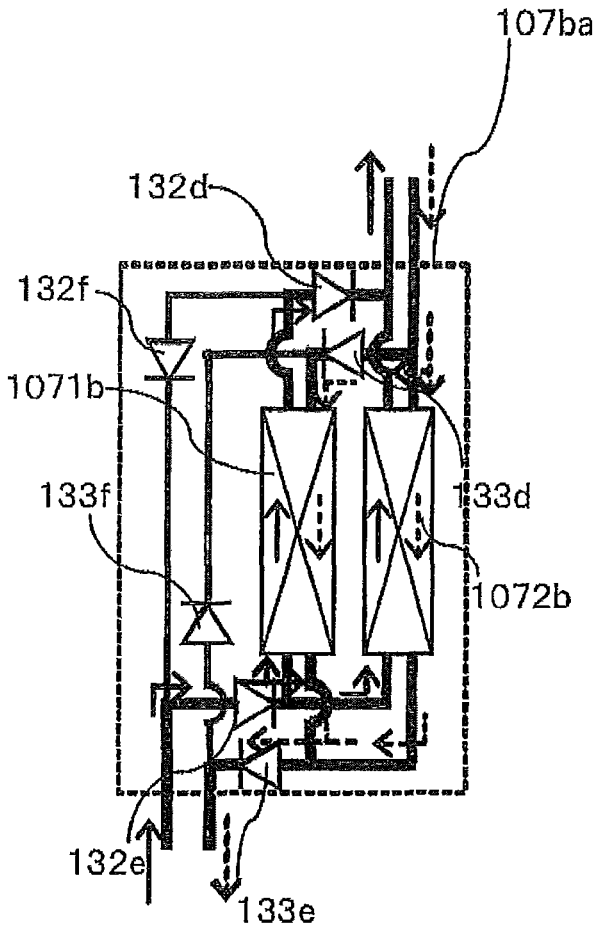
FIG. 18 illustrates the flows of the primary-side refrigerant and secondary-side refrigerant in a case where an intermediate heat exchanger 107*ba* in the air-conditioning apparatus according to Embodiment 4 of the present invention functions as an evaporator.

FIG. 18 illustrates the flows of the primary-side refrigerant and secondary-side refrigerant in a case where the intermediate heat exchanger 107*ba* in the air-conditioning apparatus according to Embodiment 4 of the present invention functions as an evaporator. In FIG. 18, pipes indicated by thick lines represent pipes through which the primary-side refrigerant and the secondary-side refrigerant flow. In FIG. 18, the flow direction of the primary-side refrigerant is indicated by solid arrows, and the flow direction of the secondary-side refrigerant is indicated by broken arrows. Hereinafter, the same applies to FIG. 19. Hereinafter, the operation in a case where the intermediate heat exchanger 107*ba* functions as an evaporator will be described with reference to FIG. 18.

After the primary-side refrigerant in a two-phase gas-liquid state that has flowed into the intermediate heat exchanger 107*ba* passes through the check valve 132*e*, the primary-side refrigerant divides into branch flows, and the branch flows flow into the heat transfer unit 1071*b* and the heat transfer unit 1072*b* in parallel, respectively. At this time, the primary-side refrigerant does not flow in a direction toward the check valve 132*d* owing to the action of the check valve 132*f*. The flows of the primary-side refrigerant in a two-phase gas-liquid state that have flowed into the heat transfer unit 1071*b* and the heat transfer unit 1072*b* absorb heat from the secondary-side refrigerant flowing in counterflow to the primary-side refrigerant, and partially evaporate, or evaporate and turn into a low-temperature, low-pressure gas state. The primary-side refrigerant that has flowed out of the heat transfer unit 1071*b* passes though the check valve 132*d*, merges with the primary-side refrigerant that has flowed out of the heat transfer unit 1072*b*, and flows out of the intermediate heat exchanger 107*ba*.

The secondary-side refrigerant that has flowed into the intermediate heat exchanger 107*ba* divides into branch flows, one of which flows into the heat transfer unit 1072*b*, and the other flows into the heat transfer unit 1071*b* via the check valve 133*d*. At this time, the secondary-side refrigerant does not flow in a direction toward the outlet of the secondary-side refrigerant in the intermediate heat exchanger 107*ba* owing to the action of the check valve 133*f*. The flows of the secondary-side refrigerant that have flowed into the heat transfer unit 1071*b* and the heat transfer unit 1072*b* in parallel are cooled by the primary-side refrigerant in a low-temperature state flowing in counterflow to the secondary-side refrigerant, and flow out of the heat transfer unit 1071*b* and the heat transfer unit 1072*b*, respectively. The flows of the secondary-side refrigerant that have respectively flowed out of the heat transfer unit 1071*b* and the heat transfer unit 1072*b* merge, and the merged secondary-side refrigerant flows out of the intermediate heat exchanger 107*ba* via the check valve 133*e*.

(Operation of Intermediate Heat Exchanger 107*ba* as Radiator)

Figure 19:
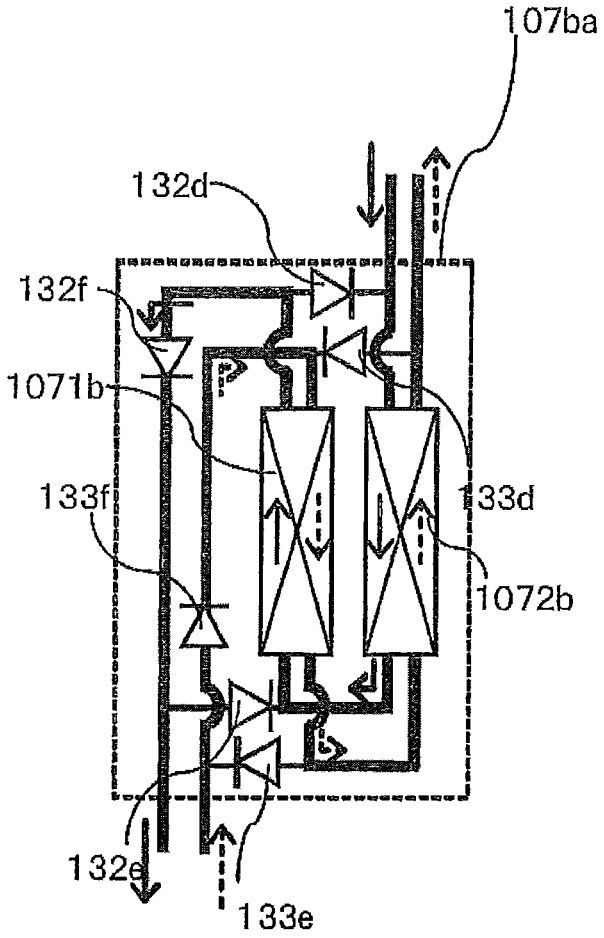
FIG. 19 illustrates the flows of the primary-side refrigerant and secondary-side refrigerant in a case where the intermediate heat exchanger 107*ba* in the air-conditioning apparatus according to Embodiment 4 of the present invention functions as a radiator.

FIG. 19 illustrates the flows of the primary-side refrigerant and secondary-side refrigerant in a case where the intermediate heat exchanger 107*ba* in the air-conditioning apparatus according to Embodiment 4 of the present invention functions as a radiator. In FIG. 19, pipes indicated by thick lines represent pipes through which the primary-side refrigerant and the secondary-side refrigerant flow. In FIG. 19, the flow direction of the primary-side refrigerant is indicated by solid arrows, and the flow direction of the secondary-side refrigerant is indicated by broken arrows. Hereinafter, the operation in a case where the intermediate heat exchanger 107*ba* functions as a radiator will be described with reference to FIG. 19.

The primary-side refrigerant that has flowed into the intermediate heat exchanger 107*ba* flows into the heat transfer unit 1072*b*, and radiates heat to the secondary-side refrigerant flowing in counterflow to the primary-side refrigerant. At this time, the primary-side refrigerant does not flow in a direction toward the heat transfer unit 1071*b* and the check valve 132*f* owing to the action of the check valve 132*d*. The primary-side refrigerant that has flowed out of the heat transfer unit 1072*b* flows into the heat transfer unit 1071*b*. In the heat transfer unit 1071*b* as well, the primary-side refrigerant radiates heat to the secondary-side refrigerant flowing in counterflow to the primary-side refrigerant. At this time, the primary-side refrigerant does not flow in a direction toward the outlet of the primary-side refrigerant in the intermediate heat exchanger 107*ba* owing to the action of the check valve 132*e*. In this way, the primary-side refrigerant flows through the heat transfer unit 1072*b* and the heat transfer unit 1071*b* in series, and during this process, the primary-side refrigerant radiates heat to the secondary-side refrigerant, and a part or the entire primary-side refrigerant condenses and turns into a two-phase gas-liquid state or liquid state. The primary-side refrigerant in a two-phase gas-liquid state or liquid state that has flowed out of the heat transfer unit 1071*b* flows out of the intermediate heat exchanger 107*ba* via the check valve 132*f*.

The secondary-side refrigerant that has flowed into the intermediate heat exchanger 107*ba* flows into the heat transfer unit 1071*b* via the check valve 133*f*, and is heated by the primary-side refrigerant flowing in counterflow to the secondary-side refrigerant. At this time, the secondary-side refrigerant does not flow in a direction toward the heat transfer unit 1072*b* owing to the action of the check valve 133*e*. The secondary-side refrigerant does not flow in a direction toward the outlet of the secondary-side refrigerant in the intermediate heat exchanger 107*ba*, either, owing to the action of the check valve 133*d*. The secondary-side refrigerant that has flowed out of the heat transfer unit 1071*b* flows into the heat transfer unit 1072*b*, and is heated by the primary-side refrigerant flowing in counterflow to the secondary-side refrigerant. In this way, the secondary-side refrigerant flows through the heat transfer unit 1071*b* and the heat transfer unit 1072*b* in series. The secondary-side refrigerant that has flowed out of the heat transfer unit 1072*b* flows out of the intermediate heat exchanger 107*ba*.

(Operation in Each Operation Mode)

In the cooling only operation mode, the intermediate heat exchangers 107*aa* and 107*ba* both act as the evaporator described above with reference to FIG. 18, and in the heating only operation mode, the intermediate heat exchangers 107*aa* and 107*ba* both act as the radiator described above with reference to FIG. 19. In both the cooling main operation mode and the heating main operation mode, the intermediate heat exchanger 107*aa* acts as the evaporator described above with reference to FIG. 18, and the intermediate heat exchanger 107*ba* acts as the radiator described above with reference to FIG. 19.

Advantageous Effects of Embodiment 4

According to the configuration and the operation mentioned above, in a case where each of the intermediate heat exchangers 107*aa* and 107*ba* functions as an evaporator where the primary-side refrigerant absorbs heat from the secondary-side refrigerant, the primary-side refrigerant flows through the heat transfer unit 1071*a* (1071*b*) and the heat transfer unit 1072*a* (1072*b*) in parallel, and in a case where each of the intermediate heat exchangers 107*aa* and 107*ba* functions as a radiator where the primary-side refrigerant radiates heat to the secondary-side refrigerant, the primary-side refrigerant flows through the heat transfer unit 1071*a* (1071*b*) and the heat transfer unit 1072*a* (1072*b*) in series. In this regard, as described above, with regard to operation efficiency, pressure loss exerts a greater influence than heat transfer capacity in the heat absorption process, and heat transfer capacity exerts a greater influence than pressure loss in the heat radiation process. Accordingly, in the air-conditioning apparatus according to Embodiment 4, in the intermediate heat exchanger 107*aa* (107*ba*) that functions as an evaporator, the primary-side refrigerant performs a heat absorption operation, and flows through the heat transfer unit 1071*a* (1071*b*) and the heat transfer unit 1072*a* (1072*b*) in parallel so that the overall cross-sectional area of the flow path becomes large. Therefore, pressure loss that tends to exert a great influence in the heat absorption process can be reduced, thereby making it possible to reduce the input to the compressor 103. In the intermediate heat exchanger 107*aa* (107*ba*) that functions as a radiator, the primary-side refrigerant performs a heat radiation operation, and flows through the heat transfer unit 1071*a* (1071*b*) and the heat transfer unit 1072*a* (1072*b*) in series so that the overall cross-sectional area of the flow path becomes small. Thus, flow velocity increases, thereby making it possible to promote heat transfer. Therefore, highly efficient operation is possible in each operation mode.

In the air-conditioning apparatus according to Embodiment 4, there exists a heat transfer unit (the heat transfer unit 1071*b* in FIGS. 18 and 19) in which the flow directions of both the primary-side refrigerant and the secondary-side refrigerant do not change even when the overall cross-sectional area of the flow path in the intermediate heat exchanger changes in accordance with each operation mode. Consequently, it is possible to take measures such as optimization of refrigerant distribution.

In each operation mode, even when the flow direction of the secondary-side refrigerant is switched, the secondary-side refrigerant flows through the indoor heat exchangers

108*n* only in one direction, and in either case, heat exchange with the indoor air is performed in the same manner, resulting in high heat exchange efficiency.

Use of the check valves 132*a* to 132*f* and 133*a* to 133*f* makes it unnecessary to perform operations other than operations of the four-way valve 106 and each valve, for switching of the overall cross-sectional area of the flow path in each of the intermediate heat exchangers 107*aa* and 107*ba* due to switching of operation modes. Consequently, in the vicinity of each of the intermediate heat exchangers 107*aa* and 107*ba*, problems such as leakage of refrigerant from valves can be prevented, thereby enabling safe operation.

The configuration of the intermediate heat exchangers 107*aa* and 107*ba* of the air-conditioning apparatus according to Embodiment 4 can be also applied to the air-conditioning apparatus according to Embodiment 3.

Figure 20:
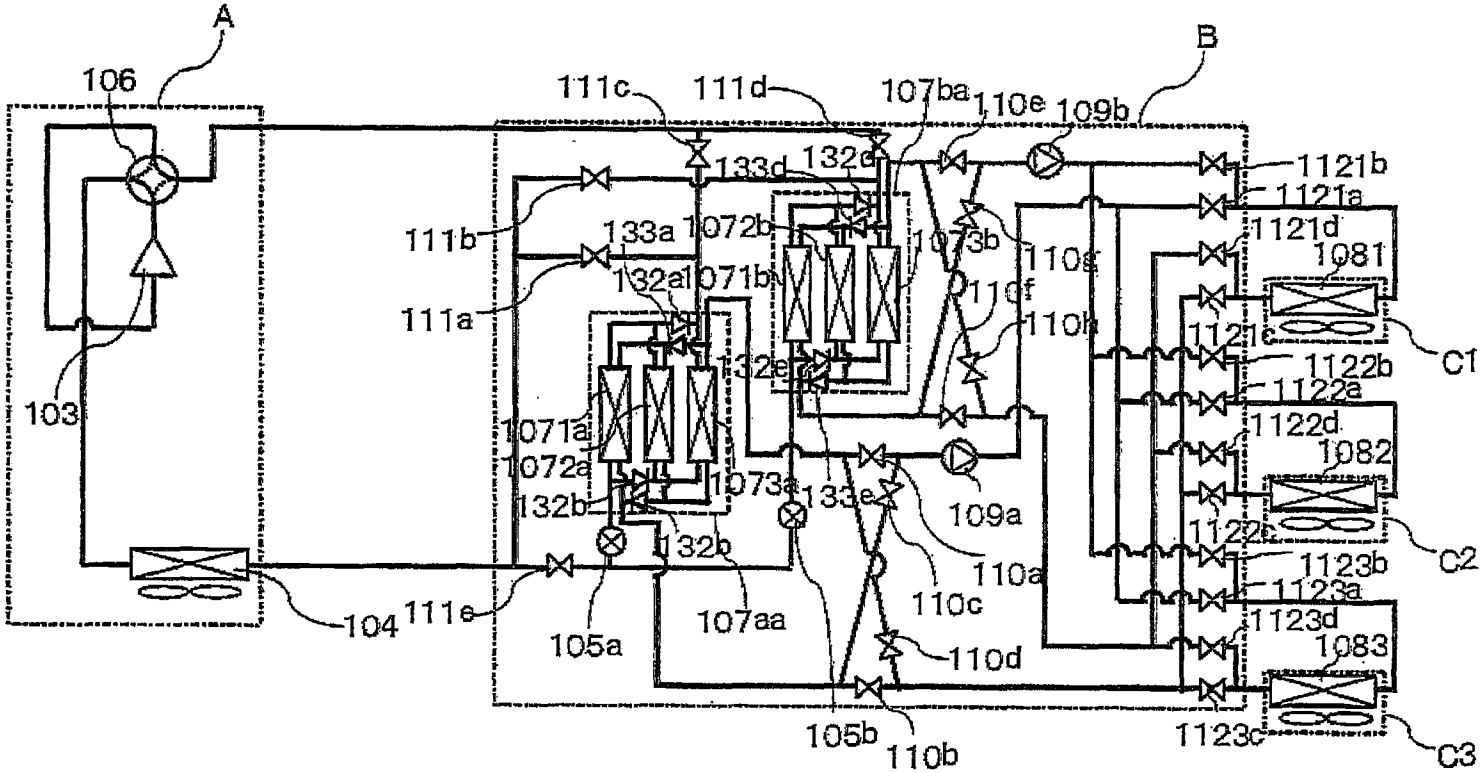
FIG. 20 illustrates a configuration in which intermediate heat exchangers 107*aa* and 107*ba* each include three heat transfer units.

While the air-conditioning apparatus illustrated in FIG. 17 is configured so that the intermediate heat exchangers 107*aa* and 107*ba* each include two heat transfer units such as the heat transfer unit 1071*a* (1071*b*) and the heat transfer unit 1072*a* (1072*b*), this should not be construed restrictively. The intermediate heat exchangers 107*aa* and 107*ba* may each include three or more heat transfer units. As an example in this case, FIG. 20 illustrates a configuration in which the intermediate heat exchangers 107*aa* and 107*ba* each include three heat transfer units (heat transfer units 1071*a* to 1073*a* (1071*b* to 1073*b*)). In a case where the number of heat transfer units is an even number, the resulting configuration is the same as the configuration illustrated in FIG. 17. That is, letting 2n (n is a natural number not smaller than 1) represent the number of heat transfer units, the number of check valves belonging to the primary-side refrigerant circuit within each of the intermediate heat exchangers 107*aa* and 107*ba* (the check valves 132*a* to 132*f* in FIG. 17), and the number of check valves belonging to the secondary-side refrigerant circuit (the check valves 133*a* to 133*f* in FIG. 17) are each expressed as (2n+1). In a case where the number of heat transfer units is an odd number, the resulting configuration is the same as the configuration illustrated in FIG. 20. That is, letting (2n+1) represent the number of heat transfer units, the number of check valves belonging to the primary-side refrigerant circuit within each of the intermediate heat exchangers 107*aa* and 107*ba* (the check valves 132*a*, 132*b*, 132*d*, and 132*e* in FIG. 20), and the number of check valves belonging to the secondary-side refrigerant circuit (the check valves 133*a*, 133*b*, 133*d*, and 133*e* in FIG. 20) are each expressed as 2n. Therefore, the number of check valves to be installed relative to the number of heat transfer units can be reduced in the case where the number of heat transfer units is an odd number.

In a case where the number of heat transfer units in each of the intermediate heat exchangers 107*aa* and 107*ba* is an even number, the number of the above-mentioned heat transfer units in which the flow directions of both the primary-side refrigerant and the secondary-side refrigerant do not change equals 50% of the total number of heat transfer units. In a case where the number of heat transfer units in each of the intermediate heat exchangers 107*aa* and 107*ba* is an odd number, provided that the number is three, the number of heat transfer units in which both of the flow directions do not change equals 33.3% of the total number of heat transfer units and its ratio becomes the lowest. That is, in the case where the number of heat transfer units is an odd number, when the number of heat transfer units is larger than three, and as the number of heat transfer units becomes larger, the ratio of the number of heat transfer units in which both of the flow directions do not change to the total number of heat transfer units becomes larger.

The check valves inside each of the intermediate heat exchangers 107*aa* and 107*ba* in the air-conditioning apparatus illustrated in FIGS. 17 and 20 may be valves that can be opened and closed. In this case, for example, although an operation according to each operation mode becomes necessary, equipment cost can be reduced.

Embodiment 5

(Configuration of Air-Conditioning Apparatus)

Figure 21:
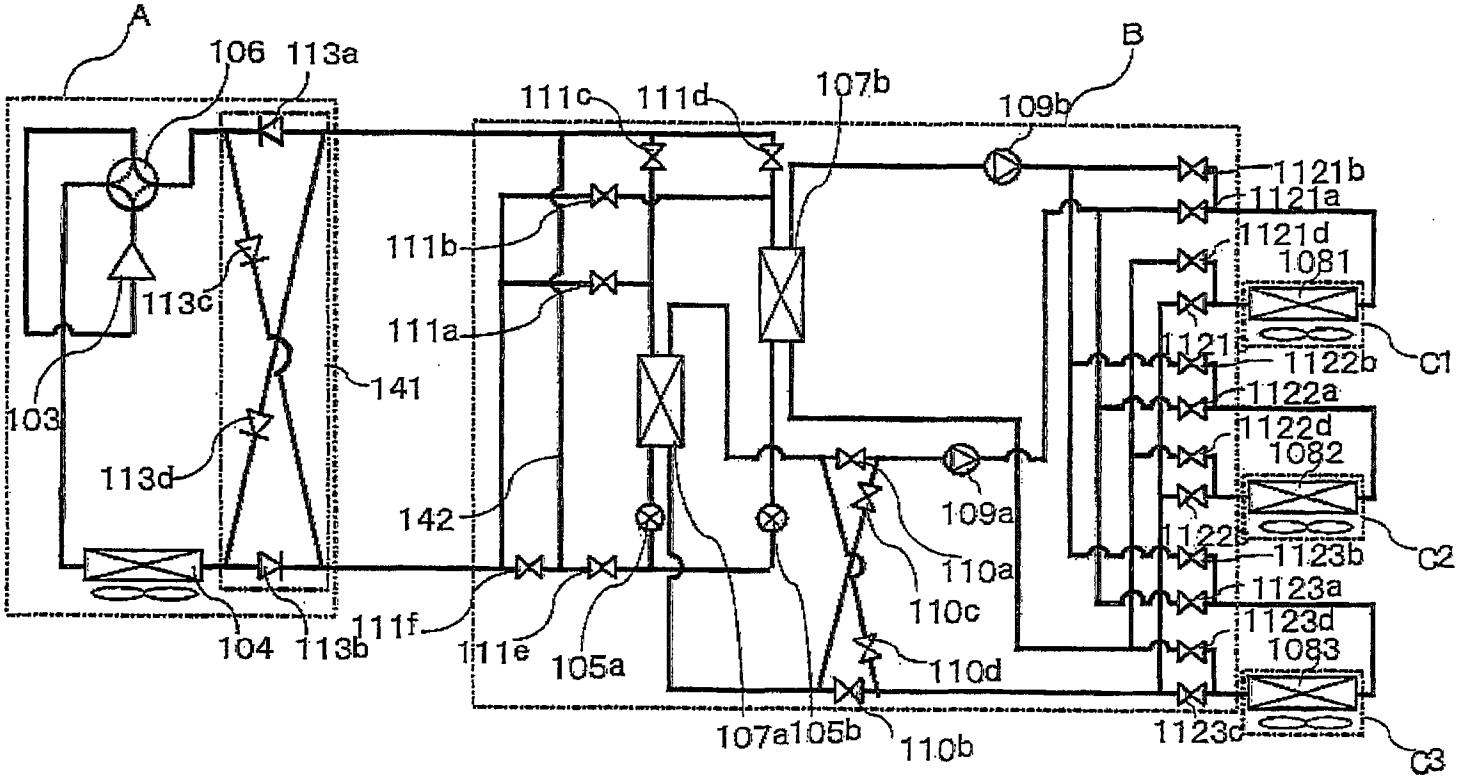
FIG. 21 is a schematic diagram of an air-conditioning apparatus according to Embodiment 5 of the present invention.

FIG. 21 is a schematic diagram of an air-conditioning apparatus according to Embodiment 5 of the present invention.

In the configuration of the air-conditioning apparatus according to Embodiment 5 illustrated in FIG. 21, the check valves 110*e* to 110*h* are omitted from the air-conditioning apparatus according to Embodiment 3.

Advantageous Effects of Embodiment 5

When the check valves 110*e* to 110*h* are eliminated as in the configuration mentioned above, the flow of the secondary-side refrigerant flowing through the intermediate heat exchanger 107*b* becomes a certain direction. Accordingly, in a case where the intermediate heat exchanger 107*b* acts an evaporator, the primary-side refrigerant and the secondary-side refrigerant are not in counter low, resulting in poor efficiency. However, generally, the effect of counterflow is greater in the case where the intermediate heat exchanger 107*b* acts as a condenser than in the case where the intermediate heat exchanger 107*b* acts as an evaporator, and of the four operation modes, the intermediate heat exchanger 107*b* acts as an evaporator only in the cooling only operation mode. Therefore, a cost reduction that more than compensates for a decrease in performance can be expected.

Such a configuration in which the check valves 110*e* to 110*h* are omitted can be also applied to the air-conditioning apparatus according to Embodiment 2.

Embodiment 6

(Installation Example of Air-Conditioning Apparatus)

Figure 22:
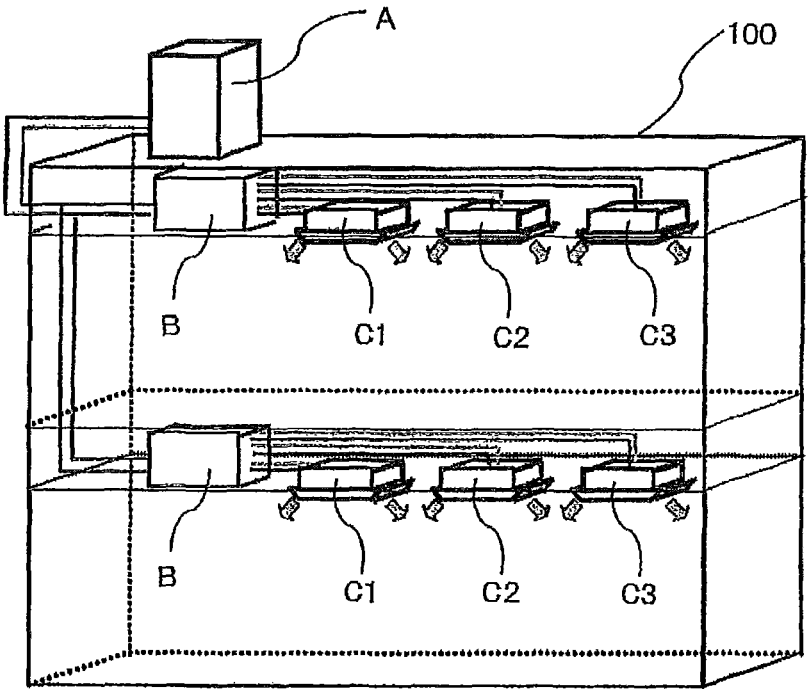
FIG. 22 illustrates an installation example of an air-conditioning apparatus according to Embodiment 6 of the present invention.

FIG. 22 illustrates an installation example of an air-conditioning apparatus according to Embodiment 6 of the present invention. The air-conditioning apparatus illustrated in FIG. 22 will be described by way of an example in which the air-conditioning apparatus is the air-conditioning apparatus according to each of Embodiments 2 to 5, and this air-conditioning apparatus is installed in a building or the like having a plurality of floors.

The outdoor unit A is installed in an outdoor space such as the rooftop of a building 100 illustrated in FIG. 22. In addition, in an indoor space that is an air-conditioning space such as a living space inside the building 100, the indoor unit C is installed at a position that allows a cooling operation and a heating operation to be performed for the air in the indoor space. As illustrated in FIG. 22, a plurality of indoor units C (three indoor units C (indoor units C1 to C3) in FIG. 22) are installed in the indoor space on each floor of the building 100. The relay unit B is installed in a non-air-conditioned space inside the building 100. The relay unit B is connected to the outdoor unit A and each of the indoor units C by refrigerant pipes. As illustrated in FIG. 22, the relay unit B is installed for each plurality of indoor units C installed on each floor. That is, heat transport between the outdoor unit A and the relay unit B is performed by the primary-side refrigerant, and heat transport between the indoor unit C and the relay unit B is performed by the secondary-side refrigerant.

The air-conditioning apparatus according to Embodiment 1 may be applied to the air-conditioning apparatus illustrated in FIG. 22. In this case, the outdoor unit A corresponds to the portion constituting the primary-side refrigerant circuit in the air-conditioning apparatus according to Embodiment 1 (excluding the intermediate heat exchanger 7), and the indoor unit C corresponds to a portion constituting the secondary-side refrigerant circuit in the air-conditioning apparatus which has the indoor heat exchanger 8 and the fan 8*a*. The relay unit B corresponds to the intermediate heat exchanger 7 in the air-conditioning apparatus according to Embodiment 1, and a portion constituting the secondary-side refrigerant circuit which has the pump 9 and the valves 10*a* to 10*d*.

While the case where the outdoor unit A is installed on the rooftop of the building 100 as illustrated in FIG. 22 has been described, this should not be construed restrictively. For example, the outdoor unit A may be installed in the basement of the building 100, in the machine room on each floor, or the like.

While three indoor units C are installed on each floor of the building 100 as illustrated in FIG. 22, this should not be construed restrictively. For example, one or another number of indoor units C may be installed.

Advantageous Effects of Embodiment 6

According to the configuration mentioned above, in the air-conditioning apparatus according to Embodiment 6, the secondary-side refrigerant such as water flows through the refrigerant pipe connected to the indoor unit C installed in an indoor space such as a living space. Therefore, leakage of the primary-side refrigerant to the indoor space can be prevented.

The outdoor unit A and the indoor unit C are installed in places other than an indoor space such as a living space, which allows for easy maintenance of these units.

REFERENCE SIGNS LIST

3 compressor, 4 outdoor heat exchanger, 4*a* fan, 5 expansion mechanism, 6 four-way valve, 7 intermediate heat exchanger, 7*a*, 7*b* heat transfer unit, 8 indoor heat exchanger, 8*a* fan, 9 pump, 10*a*, 10*b*, 10*c*, 10*d* valve, 11*a* to 11*c*, 12*a* to 12*c* check valve, 20*a* to 20*d*, 30*a* to 30*d*, 31*a* to 31*d* branch part, 100 building, 103 compressor, 104 outdoor heat exchanger, 105*a*, 105*b* expansion mechanism, 106 four-way valve, 107*a*, 107*b*, 107*aa*, 107*ba* intermediate heat exchanger, 109*a*, 109*b* pump, 110*a* to 110*h*, 111*a* to 111*f* valve, 113*a* to 113*d*, 132*a* to 132*f*, 133*a* to 133*f* check valve, 141 flow switching unit, 142 bypass pipe, 1071*a*, 1071*b*, 1072*a*, 1072*b* heat transfer unit, 1081 to 1083 indoor heat exchanger, 1121*a* to 1121*d*, 1122*a* to 1122*d*, 1123*a* to 1123*d* valve, A outdoor unit, B relay unit, C1 to C3 indoor unit.

The invention claimed is:

1. An air-conditioning apparatus comprising:

a primary-side refrigerant circuit in which a compressor, first flow switching means, a heat source-side heat exchanger, an expansion mechanism, and an intermediate heat exchanger are connected by refrigerant pipes, and through which a primary-side refrigerant flows; and a secondary-side refrigerant circuit in which a pump, a use-side heat exchanger, second flow switching means, and the intermediate heat exchanger are connected by refrigerant pipes, and through which a secondary-side refrigerant different from the primary-side refrigerant flows, wherein the intermediate heat exchanger has a plurality of heat transfer units and third flow switching means, the heat transfer units perform heat exchange so that the primary-side refrigerant absorbs heat from the secondary-side refrigerant in a cooling operation, and that the primary-side refrigerant radiates heat to the secondary-side refrigerant in a heating operation, the first flow switching means switches a refrigerant flow path so that the primary-side refrigerant discharged from the compressor flows to the heat source-side heat exchanger in the cooling operation, and switches a refrigerant flow path so that the primary-side refrigerant discharged from the compressor flows to the intermediate heat exchanger in the heating operation, the second flow switching means switches a flow direction of the secondary-side refrigerant flowing into the intermediate heat exchanger, the third flow switching means switches a refrigerant flow path so that in the intermediate heat exchanger, a cross-sectional area of a refrigerant flow path through which the primary-side refrigerant flows becomes larger in the cooling operation than that of in the heating operation, the third flow switching means switches a refrigerant flow path in the cooling operation so that the primary-side refrigerant and the secondary-side refrigerant flow through the heat transfer units in parallel, and the third flow switching means switches a refrigerant flow path in the heating operation so that the primary-side refrigerant and the secondary-side refrigerant flow through the heat transfer units in series.

2. The air-conditioning apparatus of claim 1, wherein:

the third flow switching means is configured by a check valve; and the cross-sectional area of the flow path of the primary-side refrigerant is switched by the check valve in accordance with respective inflow directions of the primary-side refrigerant and the secondary-side refrigerant that flow into the intermediate heat exchanger.

3. The air-conditioning apparatus of claim 1, further comprising:

a plurality of the intermediate heat exchangers;

a plurality of the use-side heat exchangers; and fourth flow switching means provided to the secondary-side refrigerant circuit; wherein the fourth flow switching means switches a refrigerant flow path to direct the secondary-side refrigerant flown out from any one of the plurality of intermediate heat exchangers toward each of the plurality of use-side heat exchangers, so that one of a cooling operation and a heating operation is performed in a selectable manner by each of the use-side heat exchangers.

4. The air-conditioning apparatus of claim 3, comprising:

an outdoor unit including the compressor, the first flow switching means, the heat source-side heat exchanger, and the expansion mechanism;

an indoor unit including at least one of the plurality of use-side heat exchangers; and a relay unit including the intermediate heat exchangers, the pump, the second flow switching means, the third flow switching means, and the fourth flow switching means, wherein the indoor unit is installed in an air-conditioned space, the outdoor unit and the relay unit is installed in a non-air-conditioned space, the primary-side refrigerant flows between the outdoor unit and the relay unit, and the secondary-side refrigerant flows between the indoor unit and the relay unit.

5. The air-conditioning apparatus of claim 1, wherein the intermediate heat exchanger has at least one of the heat transfer units in which respective flows of the primary-side refrigerant and the secondary-side refrigerant flow in a certain direction in both of a case where the intermediate heat exchanger functions as an evaporator and a case where the intermediate heat exchanger functions as a radiator.

6. The air-conditioning apparatus of claim 1, wherein the primary-side refrigerant is a zeotropic refrigerant mixture.

* * * * *